US006192633B1

(12) United States Patent
Hilbert

(10) Patent No.: US 6,192,633 B1
(45) Date of Patent: Feb. 27, 2001

(54) RAPIDLY DEPLOYABLE PROTECTIVE ENCLOSURE

(76) Inventor: Clint J. Hilbert, 219 S. 24th St., Allentown, PA (US) 18104

( * ) Notice: Subject to any disclaimer, the term of this patent is extended or adjusted under 35 U.S.C. 154(b) by 0 days.

(21) Appl. No.: 09/393,607

(22) Filed: Sep. 10, 1999

(51) Int. Cl.[7] ..... E04B 1/343

(52) U.S. Cl. ..... 52/2.18; 52/2.22; 52/2.23; 52/87

(58) Field of Search ..... 52/2.18, 2.22, 52/2.23; 135/87

(56) References Cited

U.S. PATENT DOCUMENTS

| | | |
|---|---|---|
| 2,812,769 | 11/1957 | Schaefer et al. . |
| 3,837,171 | 9/1974 | Scurlock . |
| 4,384,435 | 5/1983 | Polise et al. . |
| 4,625,468 | 12/1986 | Hampel . |
| 4,707,953 | 11/1987 | Anderson et al. . |
| 4,736,762 | 4/1988 | Wayman . |
| 4,800,597 | 1/1989 | Healey . |
| 4,876,829 | 10/1989 | Mattick . |
| 4,901,481 | 2/1990 | Seeley, Jr. . |
| 5,394,897 | 3/1995 | Ritchey et al. . |
| 5,546,707 | 8/1996 | Caruso . |
| 5,832,919 | 11/1998 | Kano et al. . |
| 5,852,899 | 12/1998 | Finley . |

*Primary Examiner*—Carl D. Friedman
*Assistant Examiner*—Christy M. Syres
(74) *Attorney, Agent, or Firm*—Charles A. Wilkinson

(57) ABSTRACT

A rapidly deployable protective enclosure is constructed from a flexible membrane surrounding a framework of inflatable support members each individually coupled to a central fluid distribution system. Each inflatable support member is individually repairable or replaceable from within the enclosure without effecting the structural integrity of the remaining framework. A system is provided to make the enclosure air tight, and air tight passage between modularly connected enclosures is also provided.

30 Claims, 13 Drawing Sheets

6000

6050
6350
6300
6050
6100
6200

RAPIDLY DEPLOYABLE PROTECTIVE ENCLOSURE

BACKGROUND OF THE INVENTION

1. Field of the Invention

This invention relates to rapidly erectable, protective enclosures, and more particularly, to a structure capable of being water tight and air tight and supported by a network of inflatable supports having superior strength and durability, which supports are individually repairable and replaceable from within the protective enclosure without sacrificing the operational framework or compromising the integrity of the enclosure as a whole.

2. Preliminary Discussion

Temporary shelters or enclosures are designed to be at least relatively rapidly deployable to protect occupants and their belongings from adverse or hostile environmental conditions. Campers and hikers, for example, rely on tents for protection from the rain, insects and the like. Such tents are usually lightweight, portable, easy to erect and break down, and constructed from materials particularly adapted for providing the necessary protection from all anticipated adverse conditions. A hiker's tent, for example, might be constructed primarily from waterproof material on the sides and bottom to shield the occupants from rain, storms and the like, yet have a sufficient amount of netting near the top to allow for the passage of air to and from the outside, with such netting being fine enough to keep even the most persistent insects from invading the enclosed area. A temporary, protective enclosure might, for example, also be constructed primarily from netting material if insects are a principal issue and the weather is not.

Temporary shelters or enclosures are, by their very nature, generally not indestructible, and are designed to withstand considerably less abuse than a so-called "brick and mortar" construction. Portable shelters involve a balance of transportability and protection, with the least amount of protection usually afforded to the shelter with the greatest amount of portability or transportability. Of course, the concepts of portability and protection are highly relative, depending on whether occupants are a pair of hikers traversing the mountain wilderness for two weeks, or a team of doctors desiring to establish a temporary, decontamination unit in the parking lot of a corporation for employee victims exposed to a spill or chemical disaster.

Regardless of its nature, anyone using or administrating the continued operation of a temporary shelter or enclosure should be equipped with or have available some means of repair in response to breakage or an unforeseen destructive incident. In certain situations, failure to repair a temporary shelter may have serious consequences, particularly if the occupants are relying on the integrity of the shelter to shield them from potentially life-threatening environmental hazards. Temporary enclosures for military application are often concerned with a level of protection extending far beyond pesky insects, involving protection from chemical and biological warfare, nuclear radiation and fallout, and traditional ordnance hazards, for example, projectile blasts, flying shrapnel and debris, which makes the ability to successfully repair a shelter a top, if not a life and death priority.

Portable shelters or enclosures having diverse military field application must be designed to effectively withstand many of the above mentioned chemical, biological, nuclear and ordnance-type hazards. While fabric tents or sandbag bunkers might be sufficient for certain situations, such shelters would be woefully inadequate as a means to protect soldiers from microscopic warfare agents, i.e. biological, chemical or the like agents. Traditional fabric and other military-type tents also suffer from their inability to be quickly deployed or deployable, usually involving considerable efforts during erection by a team of soldiers, particularly when the frame of the tent comprises multiple rigid supports anchored by multiple stakes and lines. An effective temporary and portable shelter, particular for military application, would be able to not only shield the occupants from particularly hazardous environmental conditions, but would also be rapidly deployable in response to emergency situations where lives are at risk and every moment counts, and also rapidly and effectively repairable so that any breach in the integrity of the enclosure can be rapidly and effectively rectified from within the enclosure, without requiring the repair person to risk exposure to outside hazardous environmental conditions.

The present inventor has perceived a need to provide a protective enclosure that is particularly suited for both military and non-military applications, that is rapidly deployable in response to emergent conditions, that is easily transportable without sacrificing protective sturdiness, and is easily repairable from within the enclosure. The present inventor has designed a protective enclosure that utilizes an inflatable, structural framework of high strength, sturdiness, and versatility, that is encased in a protective membrane that shields the occupants and their belongings from adverse and hostile environmental conditions, such as weather-related, chemical, biological, nuclear and ordnance-type hazards, such as artillery fire and the like, and that is further repairable from the inside of the enclosure so as to minimize or prevent exposure to such adverse or hostile environmental conditions during any such repair. The structural framework is preferably created from a plurality of individual tubular supports disposed in a spaced apart relationship and inflated under high pressure conditions, which transforms such tubes into so-called "air beams," making the framework extremely sturdy as compared with conventional inflatable tent structures, which are almost invariably inflated under low pressure conditions. Each tubular support is individually removable and replaceable without sacrificing the inflation integrity of the framework as a whole. Furthermore, the protective membrane that encases the inflatable framework is designed to create an air-tight environment within the enclosure, which enables use of the enclosure, incorporated with lifesupport means, in even the most hostile and hazardous environmental conditions.

The rapidly deployable enclosure of the present invention represents an advance over prior art inflatable structures not seen before. Conventional prior art enclosures are generally inflatable under low pressure conditions, i.e. one to ten pounds per square inch, which tends to be sufficient to only establish and maintain the framework in a freestanding condition. The enclosure of the present invention is inflatable under high pressure conditions, which has the benefit of increased strength and sturdiness, and transforms the inflatable framework into a network of beam-like structures of considerable rigidity. These beam-like frame supports of the present invention have the added benefit of being separately manipulatable within the structural framework, so as to be individually replaceable and repairable without sacrificing the operation and stability of the framework as a whole. The rapidly deployable enclosure of the present invention is also capable of modular operation in an interconnected fashion with other rapidly deployable enclosures to form a system or complex of modularly arranged, enclosed units. Each enclosed unit in the system could function in a distinct manner, depending on the needs of the occupants and system administrator, and each unit could therefore be equipped with unique services having distinct functionalities. A typical use might, for example, involve decontamination services, where an occupant might proceed in stages through a modular arrangement of protective enclosures and experience successively greater levels of decontamination with the passage through each successive enclosure unit.

3. Description of Related Art

The prior art is replete with temporary structures and shelters of the inflatable type, which are relatively rapidly deployable. The prior art does not, however, disclose a versatile, inflatable enclosure having replaceable, beam-like structural supports, and further capable, through air-tight means of protecting the occupants of such enclosure from a variety of hostile and adverse environmental conditions. Some examples of prior art inflatable structures are as follows:

U.S. Pat. No. 2,812,769 to Schaefer et al. discloses a hemispheric shelter comprised of interconnected inflatable air chambers initially inflated with air and then filled with a flowable, plastic substance that hardens with time. The rib-like structural framework is entirely interconnected, and each rib like unit is not individually replaceable or repairable. The Schaefer et al. tent is also not easily collapsible, since the hardened composition present within the interconnected chambers is not easily transformable back into a liquid or bottled, transportable substance.

U.S. Pat. No. 4,384,435 to Polise et al. discloses a hemispheric shelter having inflatable wall and floor sections that are only patch-like repairable, not replaceable, as with the inflatable tubular supports of the present invention.

U.S. Pat. No. 4,736,762 to Wayman discloses a framework of inflatable support tubes arranged in an interconnected fashion and fed by a single air source. The inflatable air tubes are interconnected, such that a breach in the integrity of any of the support tubes would cause the entire unit to loose air pressure and eventually collapse.

U.S. Pat. No. 4,800,597 to Healey discloses an interconnected decontamination shelter system having a rigid, structural framework that is neither modularly interconnectible with other units nor rapidly, inflatingly deployable.

U.S. Pat. No. 4,876,829 to Mattick discloses a tent having a system of interconnected tubes inflatable through a single, central manifold. The tubes are situated along the outside of the tent structure and attached to the tent wall panels by sections of flange-like material. The Mattick support tubes are particularly susceptible to external environmental conditions, not easily repairable or replaceable from within the tent, and a breach in the integrity of one of the support tubes would cause the entire unit to lose air pressure and eventually collapse.

U.S. Pat. No. 4,901,481 to Seeley, Jr. discloses a shelter having individually inflatable chambers or air cells formed within the shelter walls. The individually inflatable cells form ribs that create the framework of the shelter. Each rib is connected to a one-way valve that prevents a loss in air pressure to the entire framework upon the occurrence of a loss in air pressure to one of the cells or ribs. The Seeley, Jr. inflatable cells are not, however, individually replaceable without breaching the integrity of the tent surface.

U.S. Pat. No. 5,394,897 to Ritchey et al. discloses a system of modularly interconnected tents joined by connection modules. The Ritchey et al. system does not incorporate rapidly deployable and inflatable tent structures, nor does it provide a level of protection sufficient to shield occupants from microscopic or microbiological contaminants.

U.S. Pat. No. 5,546,707 to Caruso discloses a bladder enclosed within a fabric covering that is further riveted on both ends and capable of serving as a construction device or member. Caruso discloses construction of a goal post, soccer goal or fence post, using high pressure construction members, but does not disclose an inflatable tent structure having construction members that are individually repairable or replaceable. The Caruso construction members also have riveted end caps that are permanently attached to the inflatable tubes, making repair or replacement of such tubes or their individual parts in the field a virtual impossibility.

U.S. Pat. No. 5,832,919 to Kano et al. discloses a portable, inflatable enclosure for providing a suitable breathing environment for persons with allergies and the like. A positive pressure within the enclosure purges the enclosure of unwanted allergens and provides a steady supply of filtered air. The Kano et al. structure is composed of individually inflatable wall sections that form the inside and outside surfaces of the enclosure, which limits the repair of any one of the wall sections to a simple patch, making replacement of individual wall sections a virtual impossibility absent replacement of the entire structure.

The prior art discloses a variety of inflatable enclosures that serve as temporary protective environments. None of the prior art structures, however, employ a rapidly inflatable, structural framework akin to that of the present invention, and more particularly, none of the prior art structures disclose a rapidly deployable construction having inflatable, beam-like supports that are individually replaceable and/or repairable from within the protective enclosure. Further, none of the prior art references show or disclose a rapidly deployable enclosure capable of creating an air-tight environment for the prevention of microscopic contaminants from invading such environment. The rapidly deployable protective enclosure of the present invention provides a unique structure having particular military appeal, although non-military use is also contemplated, with a substantially rigid framework provided by inflatable structural support members that are individually repairable and replaceable from within the protective enclosure.

OBJECTS OF THE INVENTION

It is an object of the present invention, therefore, to provide a rapidly deployable protective enclosure for use in adverse or hostile conditions that is capable of supporting life within such enclosure and further capable of being structurally repaired from within such enclosure.

It is a further object of the present invention to provide a rapidly deployable protective enclosure having an inflatable framework or support structure, wherein each inflatable support member is repairable or replaceable from within the protective enclosure without affecting the operation of the remaining support members.

It is a still further object of the present invention to provide a rapidly deployable protective enclosure that is air-tight and resistant to a variety of environmental, chemical, biological, microbiological and ordnance hazards.

It is a still further object of the present invention to provide a rapidly deployable protective enclosure that is of modular construction and capable of modular, air-tight connections with other rapidly deployable protective enclosures to form clusters or groupings of protective enclosures.

Still other objects and advantages of the invention will become clear upon review of the following detailed description in conjunction with the appended drawings.

SUMMARY OF THE INVENTION

The rapidly deployable protective enclosure of the invention is comprised of a flexible membrane or covering surrounding a framework or network of inflatable support members coupled to a central fluid distribution system or manifold. Each inflatable support member is capable of individual fluid communication with a fluid source, such that the inflatable support members may be inflated individually or collectively, and deflated individually or collectively, through the use of switchable valves positioned on the manifold. Repair or replacement of any one of the individual inflatable support members may be accomplished from within the protective enclosure and without affecting the operation of the remaining support members by detaching the problem support member from the fluid distribution system and reattaching and reinflating a replacement support member after reattachment of such replacement support member to the fluid distribution system. The rapidly deployable protective enclosure of the invention is also equipped with an air-tight seal or means of ingress and egress which enables the enclosure to be completely isolated from its environment. A unique gel system is incorporated into the doorway which provides an air-tight seal between the interior and exterior of the protective enclosure. There is also provided a detachable passageway which is connectable between adjoining protective enclosures, and a unique sealing system is enclosed which enables such passage between modularly adjoining or coupled enclosures to also be air tight.

DESCRIPTION OF THE PREFERRED EMBODIMENTS

The rapidly deployable protective enclosure of the present invention is a unique structure supported by a framework of individually inflatable support members, which have unique beam-like characteristics upon inflation, and that are wrapped or encased by a flexible membrane or covering. Each of the support members is independently inflatable, valve-checked and pressure regulated to provide longitudinal stability and torsional resistance to the entire framework. The inflatable, beam-like support members are coupleable to a central fluid distribution unit, manifold, or system that divides and regulates the fluid pressure within the inflatable supports and further maintains the inflation of the support members upon decoupling of a fluid source. The inflatable supports can vary in size and diameter depending on the size of the enclosure, and can withstand high pressures, typically 100+ psi without rupture. As noted above, each beam-like support is independent of the others, allowing a single beam-like support to be replaced or repaired while the rest of the inflatable network remains freestanding, inflated and operational. The inflatable network is pocketed inside the flexible membrane and folds flat inside the enclosure in its collapsed state or as it is re-packed. Such network is also a clear span structure with no uprights or supporting posts, and the rapidly deployable enclosure of the invention does not require the use of rope, line, cord or cable to be erected.

The use of inflatable support beams makes the protective enclosure extremely lightweight and fast erecting. Having individually chambered beams also ensures greater reliability under harsh conditions, since a failure of one beam-like support will not result in the total deflation or collapse of the entire network of supports. Furthermore, providing an air tight and water tight environment enables use of the protective enclosure in contaminated or hazardous environments, and a quick-connect modular capability enables the fast erection of a group, system or village of enclosures, with each enclosure having the potential for unique functionality.

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

Figure 1:
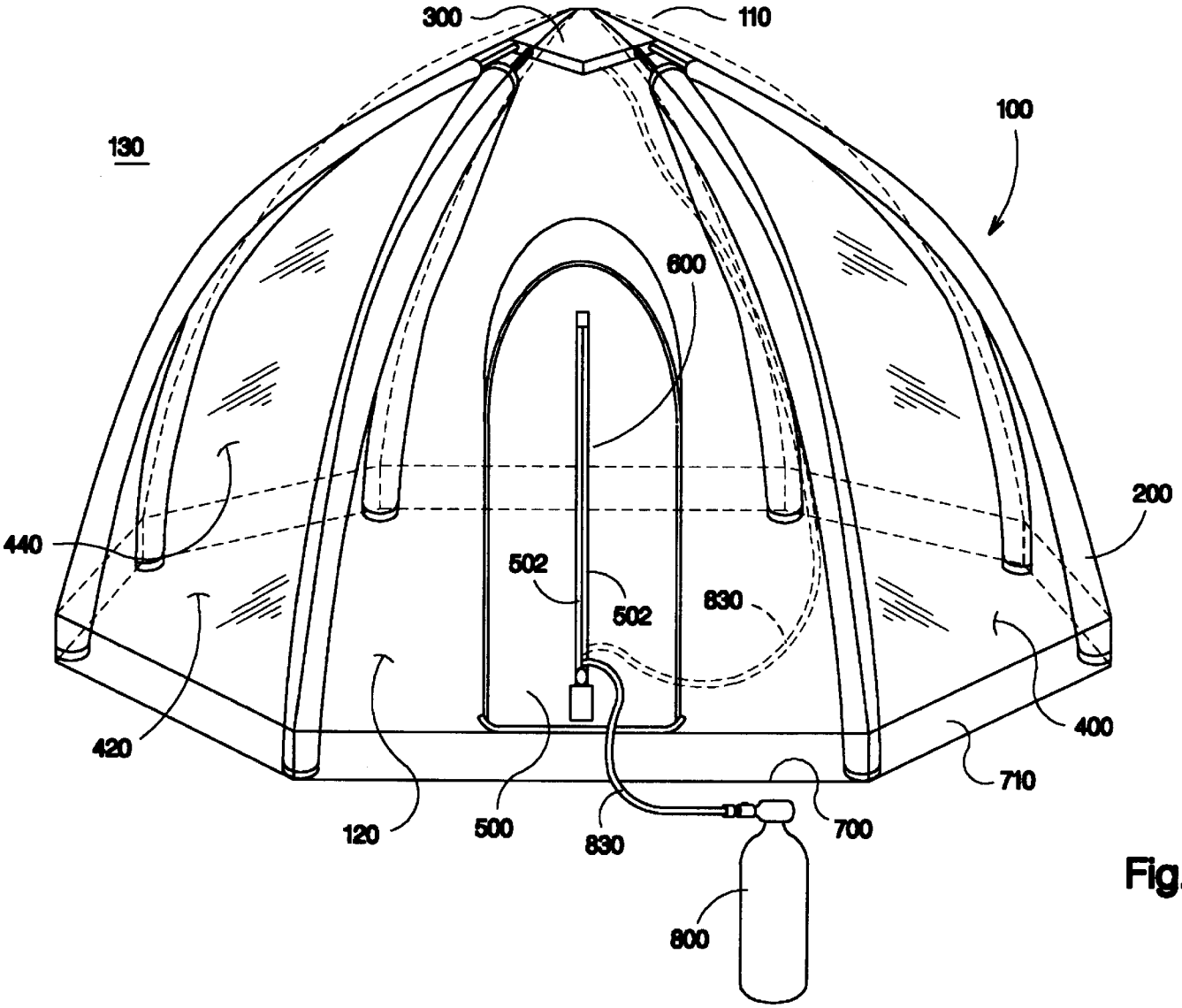
FIG. 1 is an overall view of an erected rapidly deployable enclosure of the present invention.

FIG. 1 is a diagrammatic view of a rapidly deployable protective enclosure in accordance with the present invention 100 erected for purposes of illustration into a dome-shaped structure. The general features of the enclosure of the invention will be described generally in FIG. 1, and each feature will be explored in more detail in the figures to follow. The freestanding structural framework, shown for purposes of illustration with solid lines, even through the framework is on the inside of the enclosure, comprises a network of a plurality of inflatable support members or tubes 200 disposed in spaced apart relationship and coupled near the apex 110 of the erected enclosure 100 to a manifold or fluid distribution means 300. A flexible membrane, covering or barrier 400, having an outer surface or in some cases an outer surface material 420 and an inner surface or in some cases an inner surface material 440, is extended around the framework and is adapted to be supported in the configuration of the enclosure of the invention. The inflatable supports 200 and manifold 300 are preferably removably attachable to the inner surface 440 of the flexible membrane 400 for ease of repair and replacement in the field, or during use of the enclosure in a remote location. At least one doorway 500, or a means for ingress and egress between the outside 130 and the interior 120 of the enclosure of the invention, is provided with a flexible flap or flaps 502, which are further provided with a sealing means 600 that is preferably capable of creating an air-tight seal between the exterior 130 and interior 120 of the enclosure. A flooring 700 is attached to the protective covering or membrane 400 along the lower perimeter of the enclosure, and such flooring 700 may extend upwardly from the bottom of the enclosure in a heightened or raised perimeter band 710 partially around the flexible membrane 400. The erected enclosure 100 of FIG. 1 is obtained by coupling a fluid source 800 to the manifold 300 via a coupling line 830 and communicating fluid from the fluid source 800 through valves (not shown) in the manifold 300 to the inflatable support members or tubes 200. Once the support members 200 are inflated to a predetermined degree or pressure such that the inflated support members create a freestanding framework, the fluid source 800 is decoupled from the manifold 300 and valves in the manifold 300 maintain the enclosure 100 in an erect position even after the fluid source 800 is removed from the manifold 300. One-way or check valves in the manifold, which are discussed in detail below, assure that the failure of a single inflated support member within the framework structure does not impact the pressurized condition of the remaining inflated support members, and allows for the repair and replacement of single inflatable support member without compromising the operation or erect condition of the enclosure as a whole.

Figure 2A:
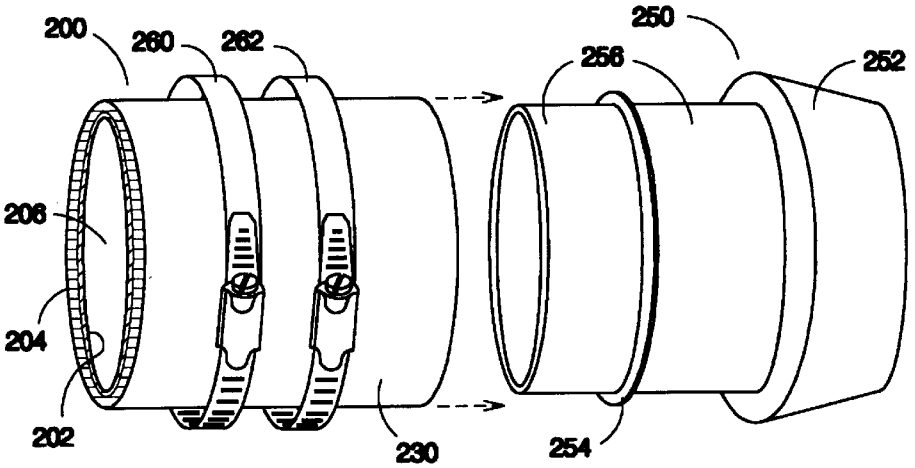
FIG. 2A is a partial view of an inflatable support member in preparation for attachment to an end cap.
Figure 2B:
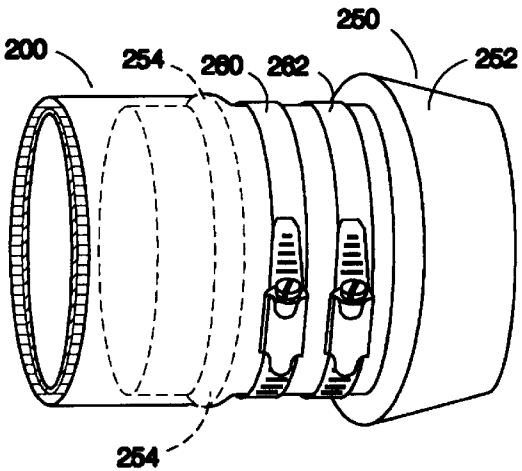
FIG. 2B is a closeup view of a connection made between an inflatable support member and an end cap.
Figure 2:
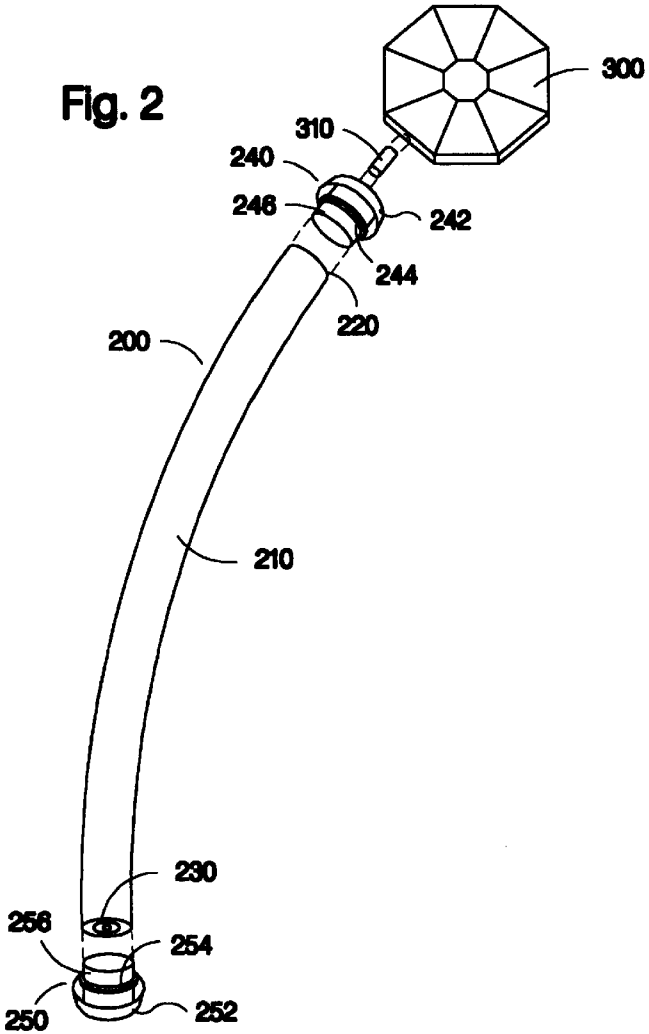
FIG. 2 is a diagrammatic view of a connection between an inflatable support member, end caps and a manifold member present within the enclosure of the invention.

FIG. 2 illustrates a diagrammatic connection between an inflatable support member 200 and the manifold 300, with the manifold 300 shown partially in phantom for purposes of illustration. Each inflatable support member 200 has a body section 210, a first end 220 preferably positionable closer to the manifold connection or apex 110 of the enclosure, and a second end 230 preferably positioned closer to the flooring or bottom of the enclosure. The inflatable support members are preferably removably attachable to first and second cap or closure means 240 and 250 on either end 220 and 230, with the details of such a connection shown more particularly in FIG. 2A, and one of the caps, and preferably the first cap 240 associated with the first end 220 of the inflatable support 200 is coupleable to the manifold 300 via coupling means 310. The coupling means 310 could be in the form of a tube section extended between the first cap 240 and the manifold 300, or such first cap 240 could even be coupled or attached directly to the manifold 300, or such first cap 240 could even form an extension of the manifold 300 onto which the end 220 of an inflatable support would be fastened. Other equivalent connections will also be satisfactory. First end cap 240 has a first enlarged head section 242, a first bead section 244 and a first reduced diameter section 246, and second end cap 250 has a second enlarged head section 252, a second bead section 254 and a second reduced diameter section 256. When the supports 200 are inflated with a fluid, the first end caps 240 prevent unwanted egress or leakage of such fluid from the internal cavity or chamber of such supports.

As shown in FIG. 2A, an inflatable tube 200, and more specifically the second end 230 of such tube 200 shown for purposes of explanation, is preferably comprised of a flexible bladder 202 disposed within a reinforced, flexible membrane 204, both defining a hollow cavity 206 therein for the passage of a fluid, and is extendable over the second reduced diameter section 256 and over the second bead section 254 of the second end cap 250 and attached thereon via attaching means 260 and 262, see FIG. 2B. The flexible interior bladder or lining 202 of the tube 200 provides the major impermeability of the inflatable tubes or support members 200, and the reinforced flexible membrane 204 will provide the principal reinforcement of the tube preventing undue expansion and possible rupture of the inner bladder 202 as well as protection from external damage. The inner section 202 and the outer flexible membrane 204 sections may be either integral or separate structures, and it will be understood that either layer could incorporate the principal function of the other in part or in whole and the inflatable tube 200 might also be composed of only a single layer. The attaching means 260, 262 shown in FIGS. 2B and 2C are shown for purposes of explanation as conventional expansible ring clamps, although it will be understood by those skilled in art that any other attaching means will be satisfactory as long as the inflatable tubular support 200 is sturdily fastened or fastenable to the end cap 250.

FIG. 2B illustrates a preferred method for removably attaching an inflatable support 200 to an end cap 250, with attaching means 260 and 262 shown fastened between the second bead section 254 and the second enlarged head section 252. It will be understood by those skilled in the art that only one attachment means, clamp 260 or 262 for example, might be sufficient to retain the inflatable support 200 against the end cap 250, or that one attaching means might be fastened about each side of the bead section 254, i.e. between the bead section 254 and the enlarged head section 252 and before the bead section 254. The enlarged diameter bead section 254 is conventionally provided for additional support of the inflatable tubular member 200 on the cap 250 and to deter or prevent the inflatable tubular member 200 from sliding off the cap 250 under high pressure inflation conditions.

Figure 2D:
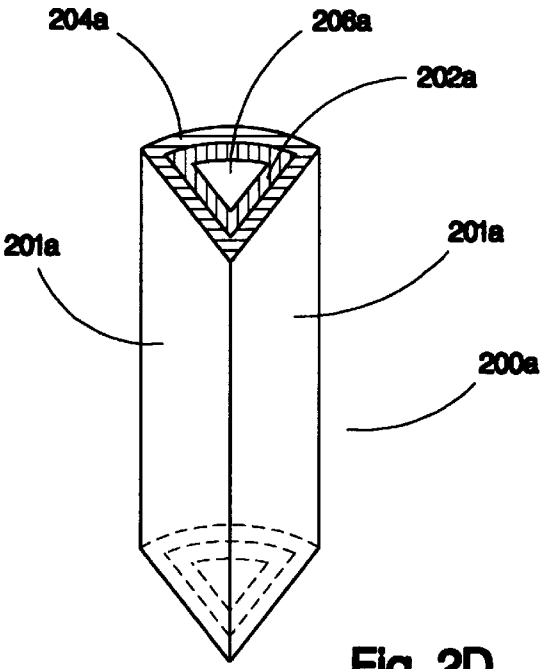
FIG. 2D is a partially cutaway view of an alternative embodiment of an inflatable support member having a cross section that is other than circular or tubular.
Figure 2C:
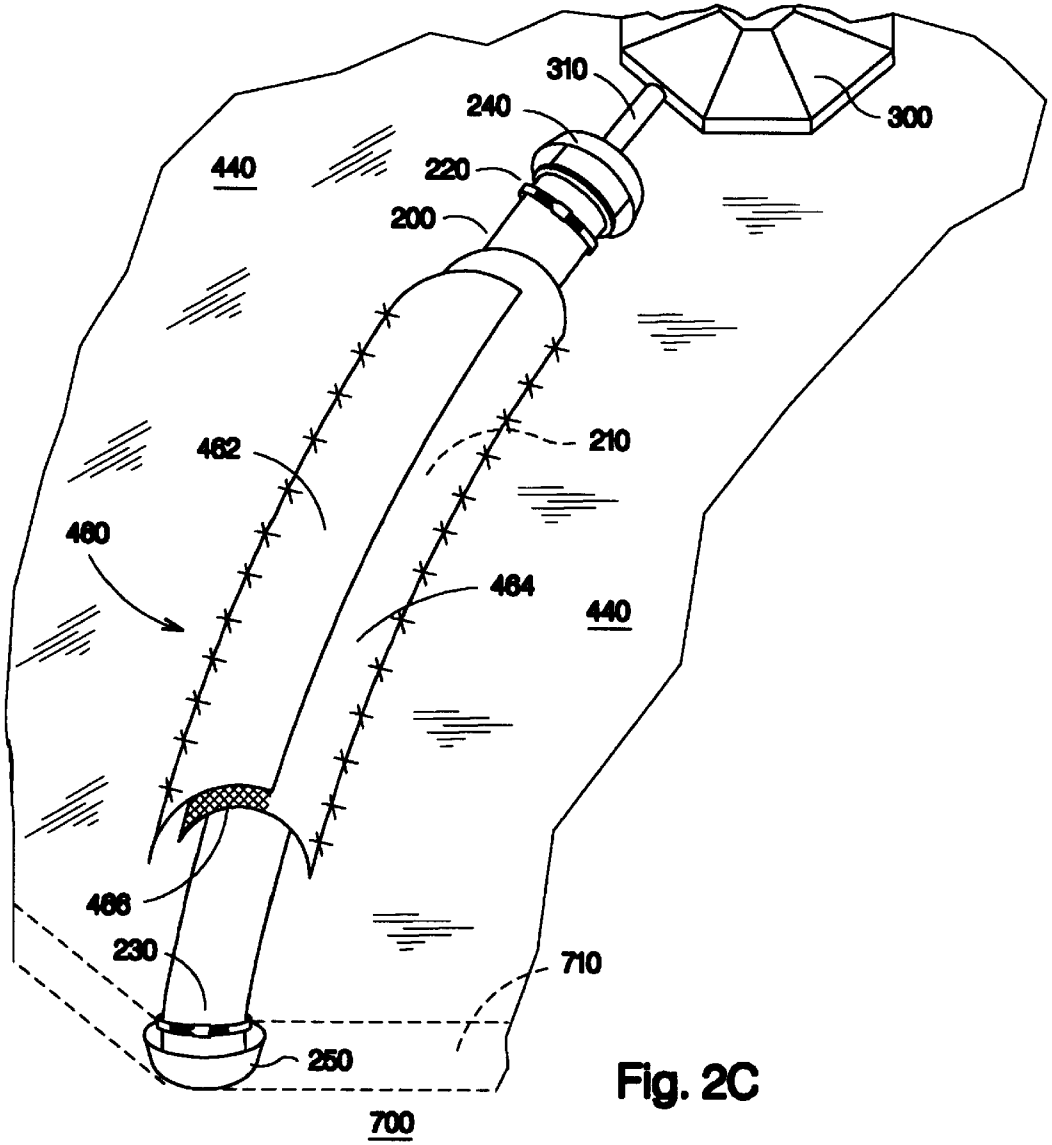
FIG. 2C is a diagrammatic view of an inflatable support member in support position against the inner surface of the protective membrane of the enclosure.

FIG. 2C illustrates a closeup view of one of the inflatable frame members 200, extending between the manifold 300 and the flooring 700, supported or pocketed against the inner surface material 440 of the flexible membrane or covering 400 by a sleeve 460, such sleeve being comprised of a first panel 462, a second panel 464 and means 466 to secure both panels together around such framing member 200. The sleeve 460, which is preferably pre-attached to the inner surface 440 of the membrane 400, maintains each inflatable member 200 in a spaced apart relationship with respect to the others during inflation and deflation of such members 200, and while such members are fully inflated to form the framework of the enclosure of the invention. While the sleeve 460 as shown in FIG. 2C covers most of the body portion 210 of the inflatable member 200, it will be understood that such sleeve could also either extend to the ends 220 and 230 of the inflatable member 200, to the first and second end caps 240 and 250, or beyond. Furthermore, the sleeve 460 as shown, formed from two distinct panels or sections, could also be formed from a single panel or section through which the inflatable member would be guided prior to inflation. Equivalent methods of retaining the inflatable support member against the inner surface of the membrane could also be devised. For example, there could be individual ties along the path of the inflatable support members 200 against the inner surface 440 of the covering 400 of the enclosure. While sleeves 460 are the preferred means for retaining the inflatable support members 200 in position or against the inner surface 440 of the enclosure 100, the important aspect is that any such retaining means may of should, be releasable so that damaged members may be removed and replaced. Furthermore, such retaining means may be inherent in the structure of the individual support members or the network of members, which may have a conformation upon the manifold so that they will tend to space themselves along the interior of the structure and maintain the desired configuration so long as they are inflated.

It is preferred, therefore, although not absolutely necessary, that the inflatable supporting members 200 be retained or pocketed in some manner against the inner surface 440 of the membrane or covering 400 during operation of the enclosure, to ensure that the framework maintains a spaced-apart relationship between framing members. The protective enclosure of the invention could, for example, as mentioned above, be constructed with some other arrangement so that an additional sleeve, attachment means or retention means, was not necessary to ensure a spaced apart relationship of the inflatable members 200 against the inner surface 440 of the membrane 400. An inflatable support member 200 could, for example, be lined along its outer surface, and more specifically along the outer surface of the flexible membrane 204 of such support member, with an attachable substance that is removably attachable to the inner surface 440 of the protective covering 400 along spaced apart seams in the membrane 400. Of course, the inflatable member 200 could be lined with an attachment substance or structure that mates with or is attached to another substance or structure that lines the inner surface 440 of the membrane 400. Or, an inflatable supporting member 200*a*, see FIG. 2D, could be designed having a body portion 201a with sloped or angled side surfaces 201a, such that inflation of the internal cavity 206a with fluid, and the resultant expansion of the bladder section 202a and membrane section 204a, results in the mating of the angled side surfaces 201a with the spaced apart seams, and more particularly, the angled relationship of the inner surface 440 joined at such seams. Having the inflatable member 200*a* configured for seating engagement upon inflation within the seams of the protective membrane 400 avoids having to provide a sleeve or some other attachment means to maintain the inflatable support members against the inner surface of the protective covering or membrane. In addition, as shown in FIG. 2D, the inflatable supporting member could have a cross section that is other than circular, i.e. it could be square, pyramidal, triangular, octagonal or the like.

Figure 3A:
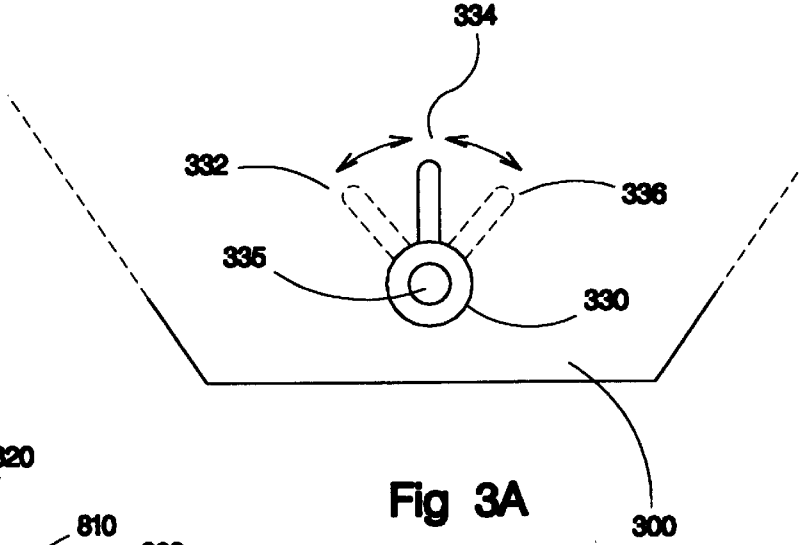
FIG. 3A is a closeup diagrammatic view of a switchable valve located on the manifold.
Figure 3:
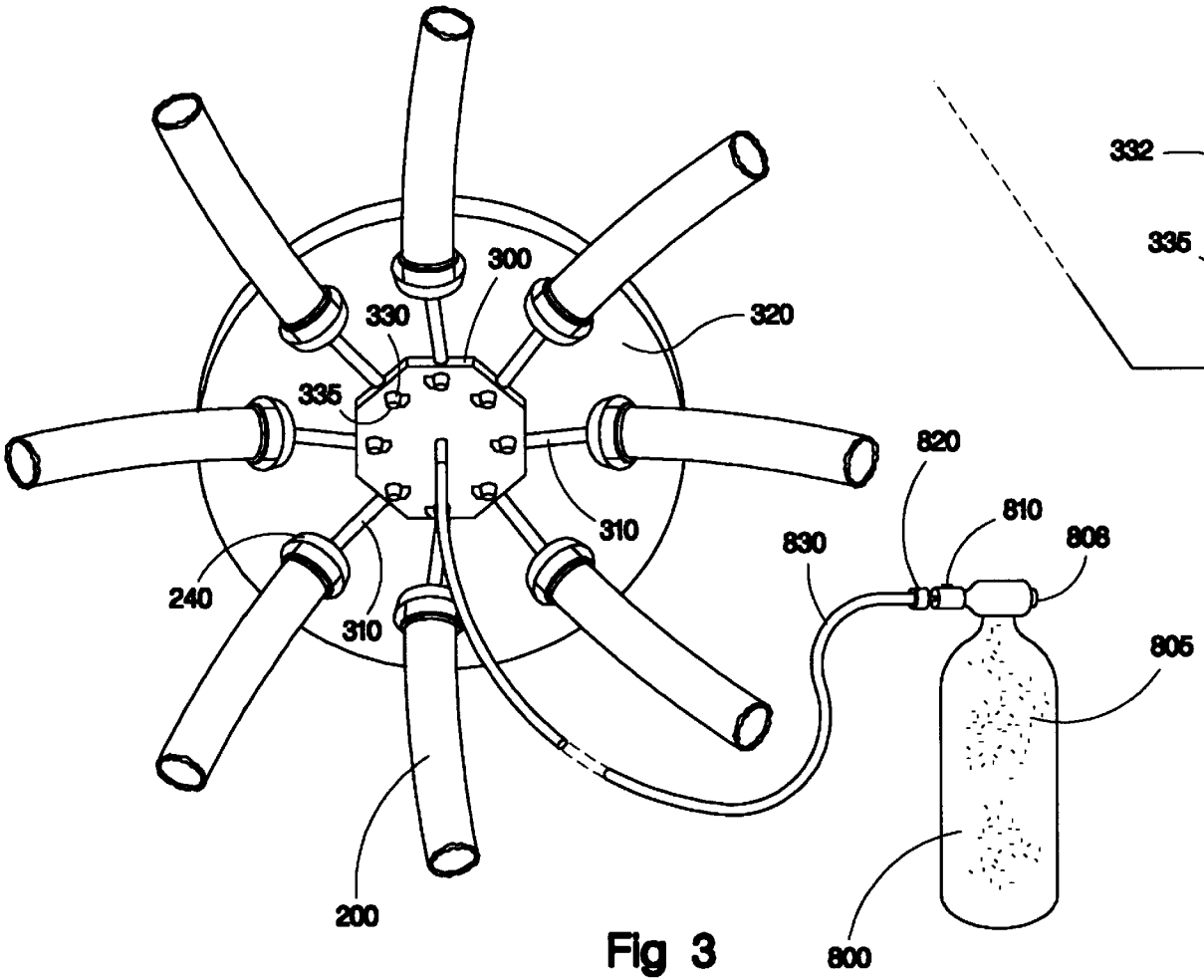
FIG. 3 is a diagrammatic view of a network of inflatable support members and a separate fluid source coupled to the manifold of the invention.

FIG. 3 is a closeup view of the fluid distribution member or manifold 300 of the invention attached to a mounting plate 320, which mounting plate 320 is fastened to the inner surface 440 of the protective membrane 400 along the apex 110 (see FIG. 1) of the enclosure 100. A fluid source 800, having a valve 808, regulator 810 and a coupling 820, is shown coupled to the manifold by a flexible tube 830. As shown generally in FIG. 1, the coupling line 830, which provides communication of inflation fluid 805 between the fluid source 800, or as shown the pressure cylinder 800, and the manifold 300 or the interior 120 of the enclosure 100, might, during the initial erection of such enclosure, extend or be temporarily supported along one of the inflatable supports 200 and along the flooring 700, and finally through the sealing means 600 in the doorway 500, so that the enclosure of the invention in the broken-down or collapsed condition can be erected using a fluid source external to the enclosure. Once the enclosure 100 has been erected, the fluid source 800 may be brought into the interior 120 of the enclosure 100 and stored within or stored externally. The manifold 300 is preferably removably attachable to the mounting plate 320 for ease of repair and replacement in the field, although having the manifold 300 permanently attached to the mounting plate 320 will also be found satisfactory. A valve 330 associated with each inflatable support member 200 that is coupled via coupling means 310 to the manifold 300 is positioned around the manifold 300. While eight valves 330 and eight inflatable supports 200 are shown, it will be understood that the enclosure of the invention will be operable with fewer or greater number of each depending on the size of the enclosure and the amount of support required to erect and maintain the framework of the enclosure. The valves 330 are also preferably easily attachable to the manifold 300 by threaded screw connections or the like, so that a defective valve can be easily repaired or replaced if necessary.

FIG. 3A is a top view of one of the valves 330 of the invention situated on the manifold 300, with the manifold 300 shown partially for purposes of illustration. A preferred embodiment of the valve 330 has three different switch positions. The first position 332 might be designated a lock position, where the valve effectively prevents fluid communication between a fluid source 800 and an inflatable support 200 coupled to the manifold 300. The second position 334 might be designated a one-way, or check valve position, where fluid communication from a fluid source 800 to an inflatable support member 200 through the valve 330 is possible, but a reverse flow of fluid from the inflatable support through the valve is not or is prevented. The third position 336 might be designated an open or bleed position, where fluid is allowed to pass unhindered from an inflatable support member 200 through the bleed means 335 in the valve 330.

The check valve position designated 334 is the most preferred method of communicating fluid from the fluid source 800 through the manifold 300 to the inflatable support members 200, because one-way check valves, as noted above, assure the independent inflatable operation of each inflatable support member 200, and the removal of one or more inflatable support members 200 from the manifold 300, either for repair or replacement, will not cause the framework of the enclosure 100 to collapse. Check valves 330 allow fluid to pass into the inflatable support members 200 and prevent fluid from unwanted passage through the valve. Should it be desired to partially or fully deflate any one of the inflatable support members 200 when such members are coupled to the manifold 300, the valve 330 associated with such inflatable support member is rotated into the bleed position designated 336 in FIG. 3A, which allows the reverse passage of fluid through the valve 330 and out the bleed passage 335. In certain situations, for example, it might be beneficial to deflate one of the inflatable support members 200 if a slow leak was found in such support member, or in the obvious situation where the protective enclosure is to be deliberately collapsed, it would be beneficial to deflate the entire structural framework, i.e. each inflatable support member, at the same time.

The check valve position designated 334 in FIG. 3A is the most preferred valve position when inflating the inflatable support members 200. Prior to inflation, the support members 200 are relatively flat, similar in appearance to an unfilled, rolled fire hose, due to the flexible nature of the both the bladder 202 and flexible covering 204. Such support members 200 might also be supported or pocketed in some manner against the inner surface material 440 of the protective covering 400 as shown and described in connection with FIGS. 2D and 2E.

Inflation of such members 200 first occurs through the coupling of a fluid source 800, which for purposes of explanation will hereinafter be described as "air," although any flowable fluid medium that causes expansion of the inflatable support members, and more particularly the cavity 206 within each support member, will be understood to fall within the description of "fluid," to the manifold 300 as shown in FIG. 3. Prior to inflation of the support members 200, all of the valves 330 are switched to the check, or one way, position designated in FIG. 3A as 334. The valve 808 is opened and the regulator 810 is then positioned so that fluid 805 from the fluid source 800 is communicated to the manifold 300 under a predetermined, regulated pressure, and such fluid 805 is then communicated through the valves 330 and through the coupling means 310 to the inflatable support members 200. The inflatable support members 200, and more particularly the cavity 206 (shown in FIG. 2A), bounded on either end 220 and 230 with first and second end caps 240 and 250, expands under the pressure of the fluid 805 until such fluid fills the cavity 206 and the bladder 202 and flexible membrane covering 204 have also expanded to a predetermined, usually tubular configuration. Once all of the inflatable support members 200 have been fully inflated, the fluid source 800 is decoupled from the manifold 300 and the check valves 330 prevent the support members 200 from deflating.

A unique feature of the inflatable support members 200 of the present invention is that such members, once inflated or filled with fluid under high pressure conditions, form beam-like structural supports of considerable rigidity and strength, that not only provide the framework for the erected enclosure, but are also repairable and/or replaceable from within the enclosure without collapse of said enclosure. It will be understood, with particular reference to FIGS. 2A through 2D and the discussion related therewith, that if an inflated support member 200 requires repair or replacement, such member may be deflated by switching the valve means 330 to the bleed orientation if such support member 200 has not already been deflated by a tear, puncture or the like, and detached or decoupled from the manifold 300 without affecting the operation of the remaining inflated support members. The support member may then be removed from the retaining sleeve 460, if such preferred sleeve is used, in preparation for the separation of such support member into its constituent elements. The body section 210 of the detached support member may then be removed from the first and second end caps 240 and 250 by releasing or loosening the attachment means 260 and/or 262, and a new body section 210, preferably stored within the enclosure, may then be fastened or attached to such first and second end caps 240 and 250. Of course, if other elements of the support members, such as the caps, attachment means or the like, require replacement or repair, such replacement elements would also be found preferably within the enclosure. The support member, now having a new body section 210, is positioned within the retaining sleeve 460, if desired, recoupled to the manifold 300, and the valve 330 is adjusted to the one-way or check orientation. After the support member has been recoupled, the manifold is re-engaged by the fluid source 800 and the deflated support member expands or inflates to a predetermined regulated pressure. If, during the re-inflation of the replaced support member, the occupant of the enclosure wishes to repressurize the remaining, intact support members, all of the valves 330 should be rotated or switched to the check valve or one-way position, insuring that all of the support members receive fluid during the inflation of the repaired or replaced support member. If the focus of the inflation is to be with the replaced support member only, then the remaining valves 330 should be switched to the lock position as discussed in connection with FIG. 3A. Since a fluid source 800 will preferably be stored or present within the enclosure of the invention in its erect state, and since each individual beam-like support member is capable of being separated into its constituent elements, all of which are replaceable, and decoupled from the manifold or central fluid distribution means without having an effect on the structural integrity of the remaining inflatable support members, replacement and repair of one or more of the beam-like structural members is fairly effortless, and can be a critical factor in determining the safety of the occupants therein. While a preferred method of construction of an inflatable support member is shown in FIG. 2, with a body 210 section being removably attached to first and second end cap sections 240 and 250, it will be understood that a repairable inflatable support member could be constructed with non-removable cap sections, in which case the inflatable support member as a whole, and not just the body section, would be repaired and/or replaced.

Figure 4A:
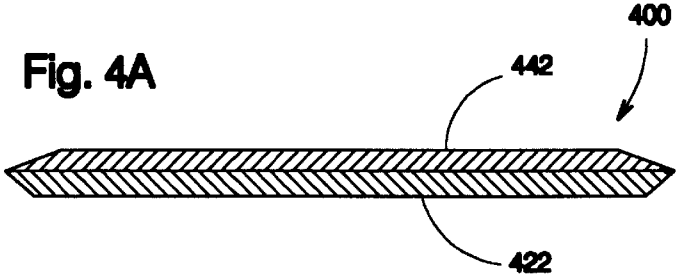
FIGS. 4 through 4B are sectional views of several different embodiments of the materials constituting the protective membrane or coverings used in a variety of areas throughout an enclosure of the present invention.
Figure 4B:
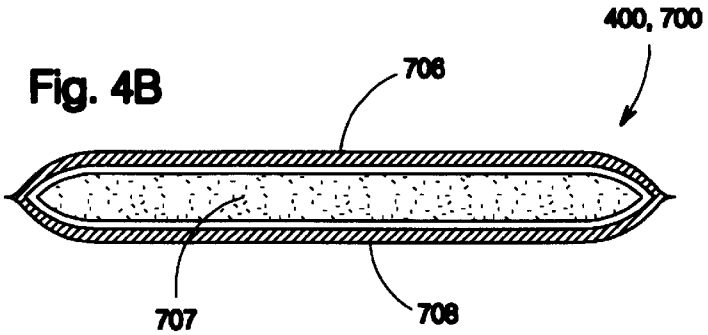
Figure 4:
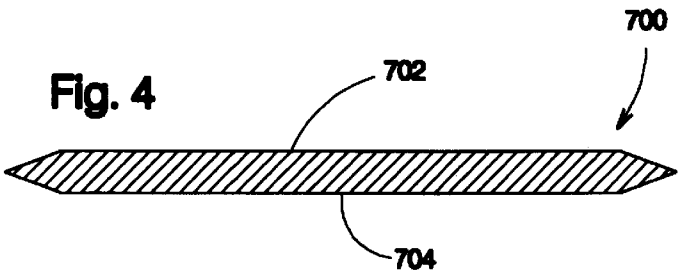

FIGS. 4 throught 4B illustrate sectional views of several embodiments of the protective coverings used for the protective membrane 400 of the invention that extends around the inflatable support framework and flooring 700 of the invention located along the bottom of the enclosure, as well as the doorway 500 and the like. It is preferred that the protective coverings 400 and 700 employ waterproof, flexible, tear-resistant materials for superior durability. The present inventor has found that a polyester scrim coated with a rubberized PVC material is satisfactorily durable in most situations. More or less durable materials may also be used in accordance with the needs of the occupants and the nature of the environment to which the enclosure of the invention is exposed. The materials used to construct the enclosure of the invention can be specially equipped for highly specialized, rigorous military requirements.

For example, the material might be manufactured using proven blackout capable fabrics for no-light signatures, capable of meeting infra-red and low light reflectance requirements currently used by the United States Air Force and Army, and capable of having an optional reversible camouflage outer covering that helps conceal its shape and reduce the thermal heat signature of the structure. And, the materials should be resistant to most chemicals, acids and the like, and be capable, possibly with the introduction of resins or the like, of withstanding extreme temperature fluctuations in an erect condition during operation and in a collapsed condition during storage. It is preferable that the protective covering, at the very least, be liquid-resistant or waterproof, capable of shedding the elements, such as rain, snow, leaves or the like, and capable of withstanding extreme wind loads.

FIG. 4 illustrates a sectional view of a single layer of material that might comprise the flooring 700, having a first surface 702 on which the occupants of the enclosure would stand, and a second surface 704 which would rest against the ground or the like. FIG. 4A illustrates a sectional view of a more preferred embodiment of a protective covering that could either be the flooring 700, the protective membrane 400, the doorway 500 and the like. In FIG. 4A, with the protective covering 400 used for example, the covering 400 is comprised of an inner layer of material 442 exposed to the inside of the enclosure and an outer layer of material 422 exposed to the environment outside of the enclosure, both having the same or different gauge material thickness. The covering of FIG. 4A could be used as a flooring, where the outer layer of material 422 is constructed from a heavier gauge material than the inner layer 442, since the outside of the enclosure is likely to encounter sharper objects than the inside. The present inventor has found a 30 plus ounce gauge fabric on the exterior of the enclosure of the invention and a 24 ounce gauge fabric lining the interior of the enclosure to be satisfactory. Of course, a heavier material on the inside than on the outside will also be operable. The strength of the material will be most dependent on the nature of the surroundings or the environment. FIG. 4B represents a most preferred embodiment of the protective covering 400, flooring 700 or doorway 500, having an inner foam or compressible layer 707 sandwiched between two outer layers of material 706 and 708, with the outer layer 708 exposed to the ground or the outside environment and preferably of a heavier gauge material than the inner layer 706. The inner compressible layer 707 provides additional protection from uneven or pointed objects situated on the ground on which the enclosure might be erected and positioned. While an insulative layer 707 is preferably incorporated into the membrane material, it could also be attached to a membrane material not already equipped with an insulative layer, such as shown in FIGS. 4 or 4A, for example, as an after market add-on or the like. Consequently, the enclosure of the invention is feature-expandable, providing users with the flexibility to create a rapidly deployable enclosure specifically suited to meet their needs, and capable of being enhanced with additional features if such needs change. The membrane material is also designed to be easily repairable from within the enclosure, requiring, depending on the size of the hole, either an adhesively attached patch or a heat-sealable patch that is heat applied over the hole until the patch bonds to the intact protective membrane around the hole.

Figure 5A:
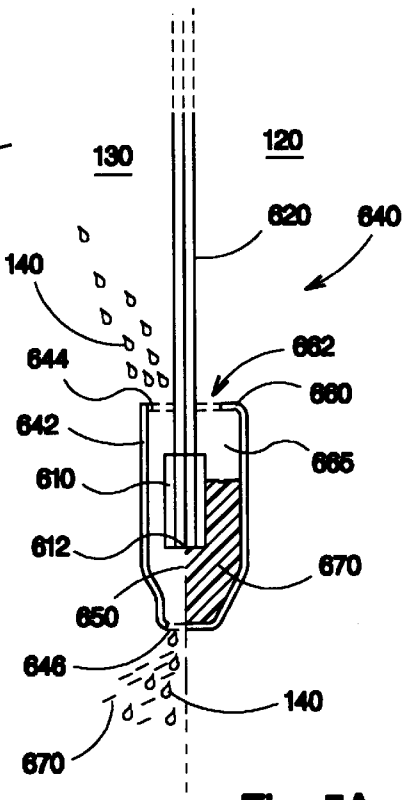
FIG. 5A is a side view of the sealing means showing a fluid or gel-based system that provides air-tight sealing.
Figure 5:
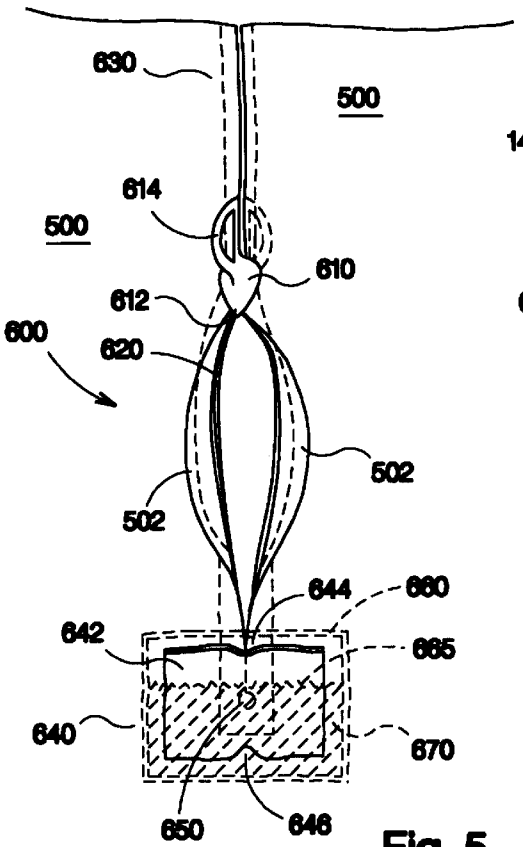
FIG. 5 is a diagrammatic view of the sealing means of the invention located on the doorway of an enclosure of the invention.

The protective enclosure of the present invention is designed to be air-tight, and the sealing means 600 is illustrated in detail in FIG. 5. A positive pressure system incorporated into the operation of the enclosure of the invention maintains a livable environment, with the introduction of fresh, uncontaminated or filtered air and evacuation of stale air from the interior 120 of the enclosure 100, and this positive pressure system will be discussed in detail below. For purposes of our present discussion, the positive pressure system assures that any break in the protective membrane 400 will result in the directional passage of air through such break from the interior 120 of the enclosure 100 to the exterior 130, thereby avoiding the introduction of potential contaminants to the interior 120 of the enclosure 100 from the outside environment 130. Therefore, pinhole-sized breaks in the protective membrane are usually not a major concern.

FIG. 5 illustrates the sealing means 600 of the invention, comprised of a sliding closure member 610, having a tip portion 612 and a handle portion 614, that is slidable along an interlocking track 620, such track 620 covered by flaps of material 502 from the doorway 500. In less preferred embodiments, where air-tightness might not be a concern, the sliding member 610 and track 620 might be in the form of a conventional zipper arrangement or the like. However, in a more preferred embodiment, the track portion is a heavy duty, preferably triple chambered, interlock arrangement of the ZIPLOC® variety, which creates an air tight seal between the interior 120 and exterior 130 of the enclosure with the advancement of the sliding member 610 from the upper section 630 of the track 620 to the lower section 640 of the track 620. An orifice 650 is located at the lower terminus of the track 620 and extends between the interior 120 of the enclosure 100 of the invention and the exterior 130 of the enclosure 100. An outer covering 642 attached to the doorway 500 and covering the orifice 650 as shown includes a passageway, preferably in alignment with the track 620 and extending from the upper section 644 of the covering 642 to an exit section 646 located in the lower section of the covering 642, while an inner covering 660 attached to the inside surface of the doorway 500 and covering the orifice 650 defines a chamber 665 for the retention of a thick, non-toxic, flowable substance 670, such as a gel or the like.

Due to the particular construction of the slidable member 610 in relation to the track 620, a small passageway through the track 620 between the interior 120 and exterior 130 of the enclosure tends to exist just beyond or in front of the tip portion 612 as the slidable member 610 is being advanced along the track 620. As the slidable member 610 reaches the terminus of the track 620, or the orifice 650, a small passageway or opening would exist in the track 620 between the interior 120 and exterior 130 of the enclosure. The gel substance 670 present within the chamber 665 creates a seal between the orifice 650 extending between the interior 120 and exterior 130 of the enclosure, and thus seals off the small passageway or opening present immediately beyond the tip portion 612 of the slidable member 610. The gel substance 670 has a level of viscosity, being preferably fairly low, such that it creates a surface tension seal over the orifice 650 due to the positive pressure system (to be discussed later) created in the interior 120 of the enclosure 100, and so that minor passage of the substance 670 might also occur through the orifice 650 and out the drainage section 646 without resulting in rapid depletion of the gel substance 670 from the chamber 665.

FIG. 5A is a diagrammatic side view of the lower section 640 of the track 620 between the interior 120 and exterior 130 of the enclosure of the invention with the slidable member 610 positioned at the terminus of the track 620 and with the tip portion 612 adjacent the orifice 650 extending between to the two coverings 642 and 660. The gel substance 670 present within the chamber 665 creates a seal around the orifice 650, and also provides constant lubrication to the slidable member 610 and the track 620 on which such member 610 slides. The passageways 644 and 646 allow rain or the like 140 to pass between the outer covering 642 and the doorway 500, while the exit section 646 also provides passage for any gel substance 670 that passes through the orifice 650. The gel substance 670, as noted above, can also be considered a lubrication means, particularly for the track 620 and the slidable member 610, and as the gel substance 670 is used or exhausted for lubrication or as a seal for the orifice 650, its level within the chamber 665 may drop. Once the level of the gel substance 670 drops below the orifice 650, additional gel substance 670 should be introduced into the chamber 665 through a passage 662 or the like. To assist in determining the level of the gel substance 670 within the chamber 665 from the interior 120 of the enclosure, the gel substance 670 might be colored and the chamber covering 660 might be translucent, transparent or the like. While a refillable gel system is disclosed, it will be understood that an equivalent system could be designed and implemented that does not require refilling, or operates under different principles, as long as the small passageway or gap present immediately after the tip portion 612 of the slidable member 610 is blocked off to create an air tight seal.

Figure 6:
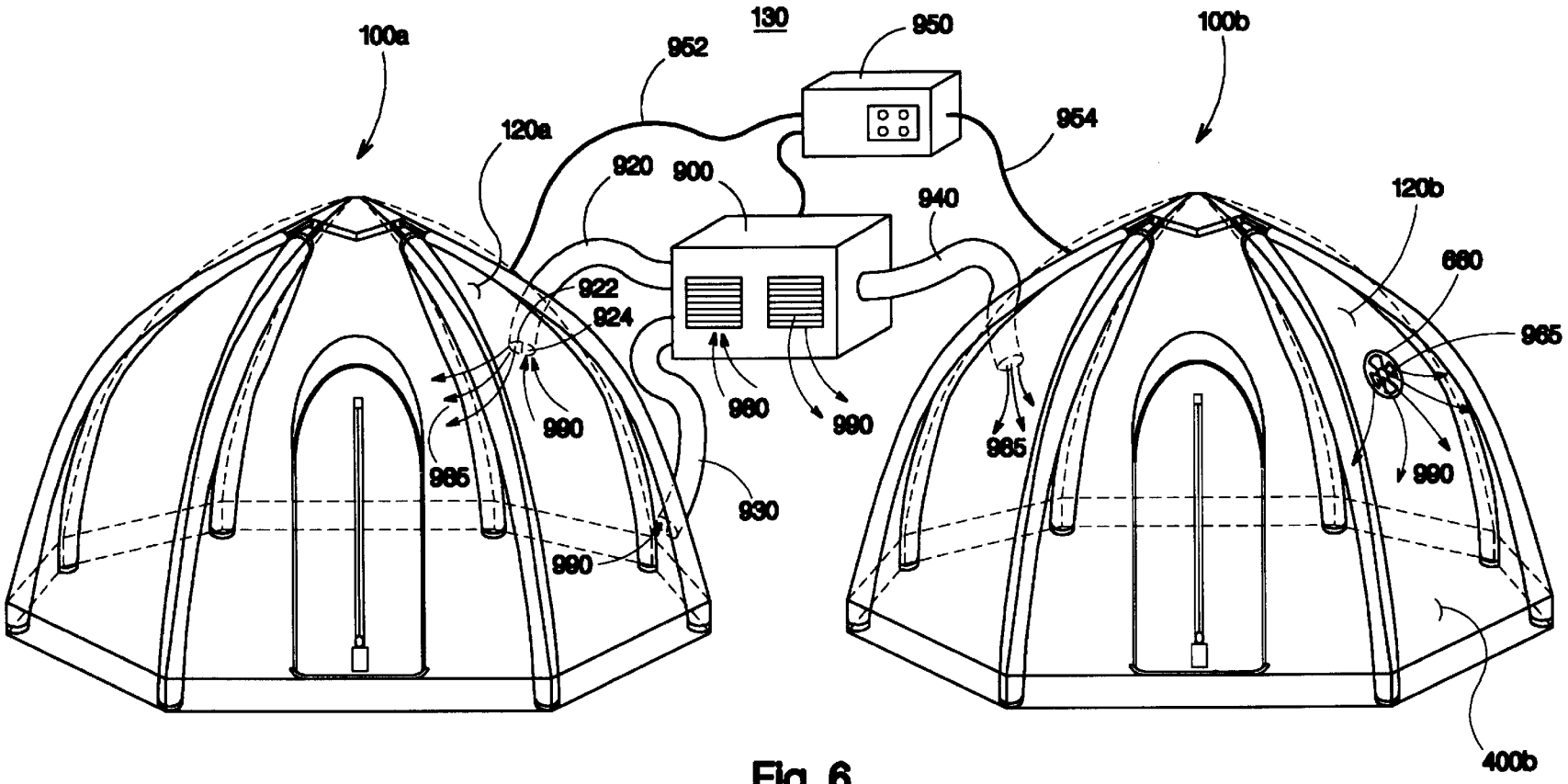
FIG. 6 is a diagrammatic view illustrating the operation of an environmental control unit on a pair of enclosures.

The positive pressure system discussed above is shown for example in FIG. 6, which illustrates two enclosures 100*a* and 100*b* positioned in an outside environment 130 and having coupled thereto an environmental control unit 900 powered by a generator 950 or the like. The generator 950 could also act as a power source to the enclosures 100*a* and 100*b* through power lines 952 and 954, particularly if the enclosures are equipped with an optional electrical system potentially consisting of a mini power panel, lighting, quick connect power cables, switches, wiring and all other items as necessary for properly functioning lighting and power systems. The environmental control unit 900 is coupled to the enclosures 100*a* and 100*b* through coupling means 920 and 940, which might be hollow conduits or the like, and while a single unit 900 is shown connected between two enclosures 100*a* and 10*b*, it will be understood that a single unit 900 could service only a single enclosure or more than two enclosures as shown, with the capability and capacity of the unit 900 determined generally by its size and the power source 950. The environmental control unit 900 is primarily responsible for maintaining livable conditions within the enclosures 100*a* and 100*b*, particularly if the outside environment 130 is contaminated or exposed to adverse human conditions, and even more particularly if such enclosures are equipped with air-tight doors and seals as described in connection with FIGS. 5 and 5A. At a minimum, the environmental control units 900 should be capable of regulating and maintaining a comfortable temperature within the enclosures, preferably between fifty and ninety degrees fahrenheit, and also capable of filtering outside air 980 into breathable and non-harmful inside air 985.

The forceful introduction of clean air 985 into the enclosures causes a positive pressure inside the enclosures, requiring the clean air 985 to be vented to the outside 130 in some fashion. Two possible methods of venting the inside clean air 985 are shown. The first method is illustrated in connection with enclosure 100*a*, where the environmental control unit conduit 920 is bifurcated into an outlet section 922, through which is passed clean air 985, and an inlet section 924 for the passage of stale, inside air 990 to the outside 130. In the first method, the passage of inside air 990 would preferably occur through the same conduit 920 and through the environmental control unit 900 as shown, or as an alternative, a second conduit 930 might be provided solely as a means to vent inside air 990 to the outside 130. In either embodiment, it would be preferable if both the outlet means 922 and the venting return means 924 or 930 were controllable so that the positive pressure present within the enclosure 120*a* could be modified or manipulated as required. In other words, if the enclosure experiences a tear in one of the protective membranes, the return means 924 or 930 could be closed so that the inside air 990 escapes through the tear as opposed to returning to the outside 130 through the environmental control unit 900. A second possible method of venting inside air 990 to the outside 130 is illustrated on the enclosure 100*b* with the introduction of a unidirectional air flow valve 960 in the protective covering 400*b* that has adjustable vents 965 for regulating the venting of the inside air 990. The valve 960 might preferably include a carbon filter and act like a low pressure check valve, allowing the passage of air 990 to the outside 130 but preventing the passage of potentially contaminated air 980 to the inside 120*b*. Again, if the enclosure 100*b* experiences a puncture, tear or the like, the valve 960 can be regulated or closed so that the positive pressure system forces air 990 solely through the tear and not through the vent valve 960. If the enclosure becomes over pressurized, the valve 960 could be manipulated so that more air flow occurs through the vents 965. The positive pressure system occurring through the forceful introduction of air 985 into the enclosures minimizes the need to worry about pinhole-type breaks in the protective membranes or enclosures. The positive pressure, as discussed in connection with FIGS. 5 and 5A, urges the gel system 670 to seal the orifice 650, although a sufficient amount of gel 670 residing in the chamber 665 having a certain viscosity and material property could act as a seal under surface tension without a positive pressure within the enclosure.

Various sealing arrangements between adjacent flexible inflatable units of the invention may be used. However, a preferred arrangement, shown hereinafter in FIGS. 7 through 7G, achieves sealing between units by the use of compression members within channel members located on the edges of adjoining wind cover membranes. Such channel members are generally closed on three sides and have open sides facing each other. Each of the channels has a slightly raised lip on its lower side adjacent its open side and one of the channel sections has a longer outer side adapted to pass over the other slightly smaller channel section. The edges of the membranes from which the wind covers and intermediate coupling are formed are provided with a compression ring formed from a soft pliable substance. When these soft compression members are inserted into the channel sections, the compression members tend to remain in place over or upon the channel sections as a result of the lips in the bottom of the channel sections. When the edges of two membranes thereafter are placed together in an abutting arrangement with the soft pliable compression sections within the channel sections and the extended top section of the larger channel section across the top of the slightly smaller channel section, compression of the pliable compressive members together or toward each other through the joining and mating of the channel sections in which such compressive members are positioned causes the space between the channel sections and compressive members to be completely blocked off, thereby effecting an air tight seal around the perimeter of the joined channel sections. To maintain such channel sections and pliable compressive ring sections in an abutting, compressed relationship, the channel sections may be additionally clamped together by a suitable clamp. The operation of this sealing arrangement is described further in conjunction with FIGS. 7 through 7G below.

Figure 7:
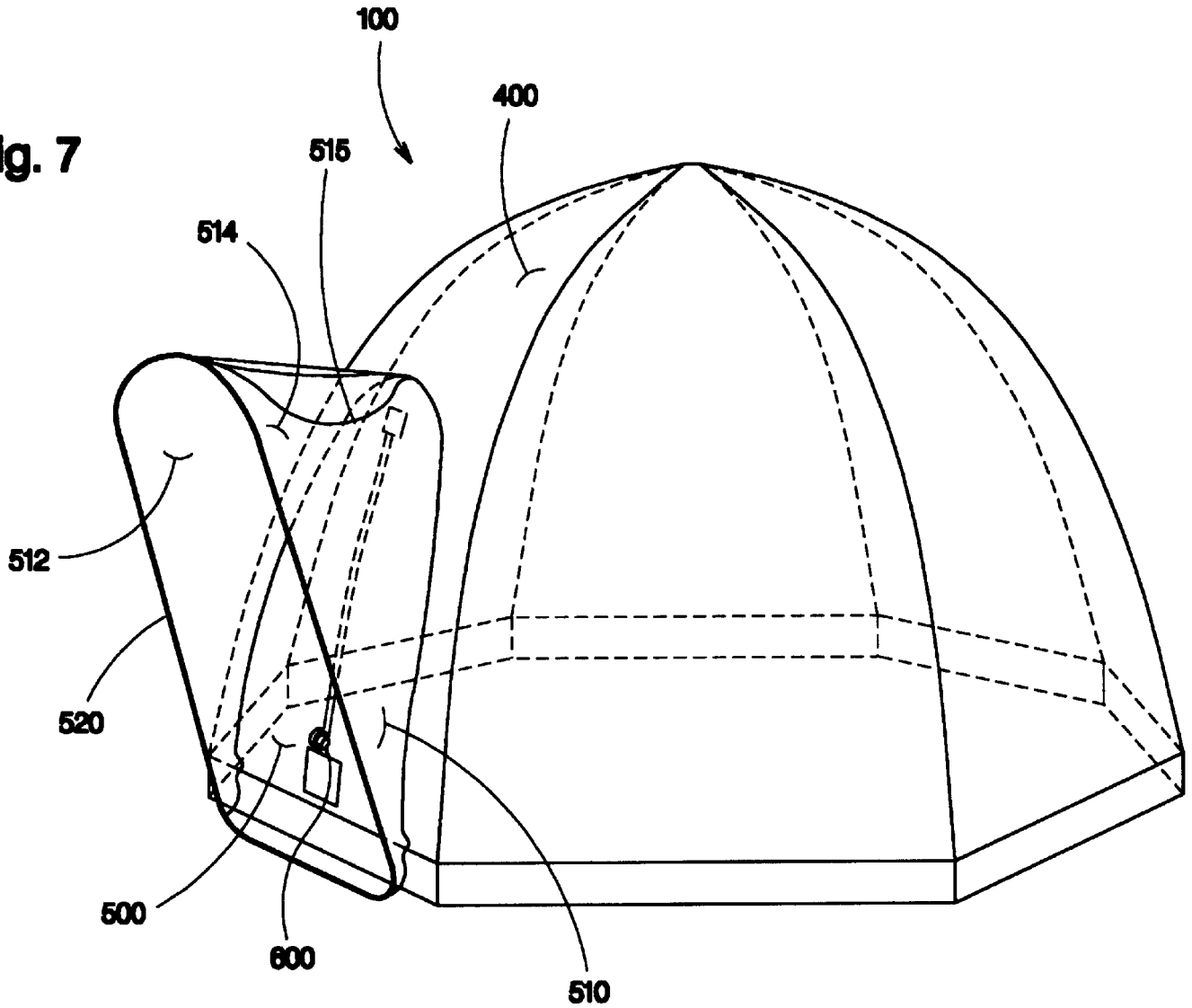
FIG. 7 is a diagrammatic view of a wind cover extending away from the doorway of an enclosure.

FIG. 7 is a diagrammatic view of the doorway 500 of the enclosure of the invention 100 having a sealing means 600, an outer wind cover 510 extending away from the doorway 500 and a wind cover sealing channel 520 which, as will be discussed in detail below, allows for the modular connection of multiple enclosures. The wind cover 510, which is preferably comprised of the same type of material as the protective membrane or covering 400, having an inner surface material 512 and an outer surface material 514, is maintained in an extended position away from the doorway 500 and against the ground through the use of a bendable, spring-like band or hoop 515, and provides an element of wind protection during ingress and egress through the doorway 500 and sealing means 600. If wind protection is not desired, the cover 510 may be folded back and retained against the doorway 500 using retention means such as straps, clips or the like (not shown).

Figure 7A:
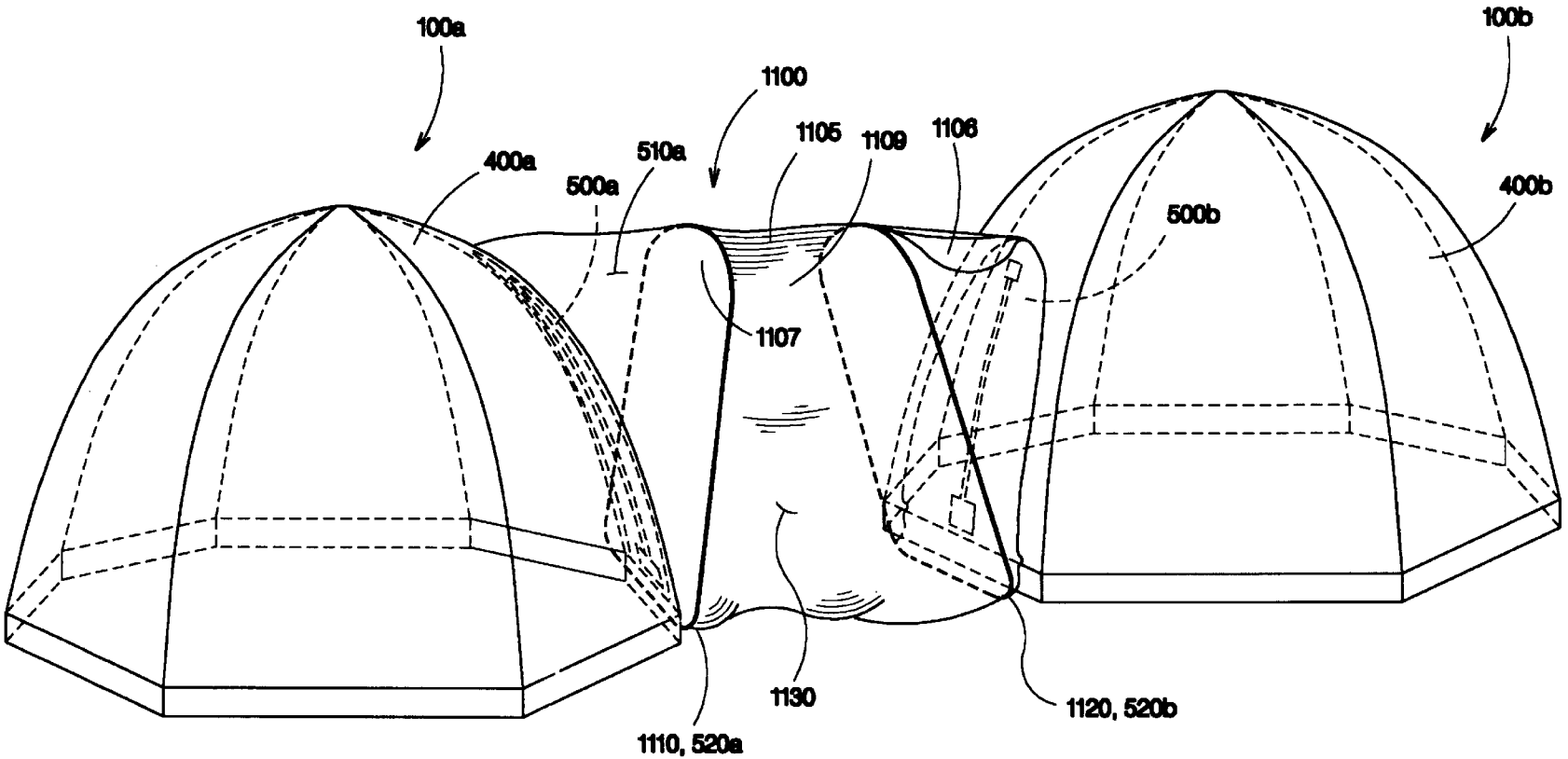
FIG. 7A is a diagrammatic view of a detachable passageway attached between two wind covers from two different enclosures.

FIG. 7A illustrates the implementation of a detachable passageway 1000 between two enclosures 100*a* and 100*b* of the invention, and more specifically between the two wind covers 510*a* and 510*b*. The passageway 1100 is comprised of a flexible membrane 1105 having an inner surface material 1107 and an outer surface material 1109, such membrane having the same material properties as the flexible membranes or covering 400*a* or 400*b* used on the enclosures 100*a* or 100*b*, and a pair of channel sections or channels 1110 and 1120 along each edge as shown, with an interior passage 1130 defined therein. The details of the channels 1110 and 1120 of the detachable passageway 1100, as well as the details of the channels 520*a* and 520*b* of the respective wind covers 510*a* and 510*b* are illustrated in FIGS. 7B through 7G.

Figures 7B, 7C, 7D:
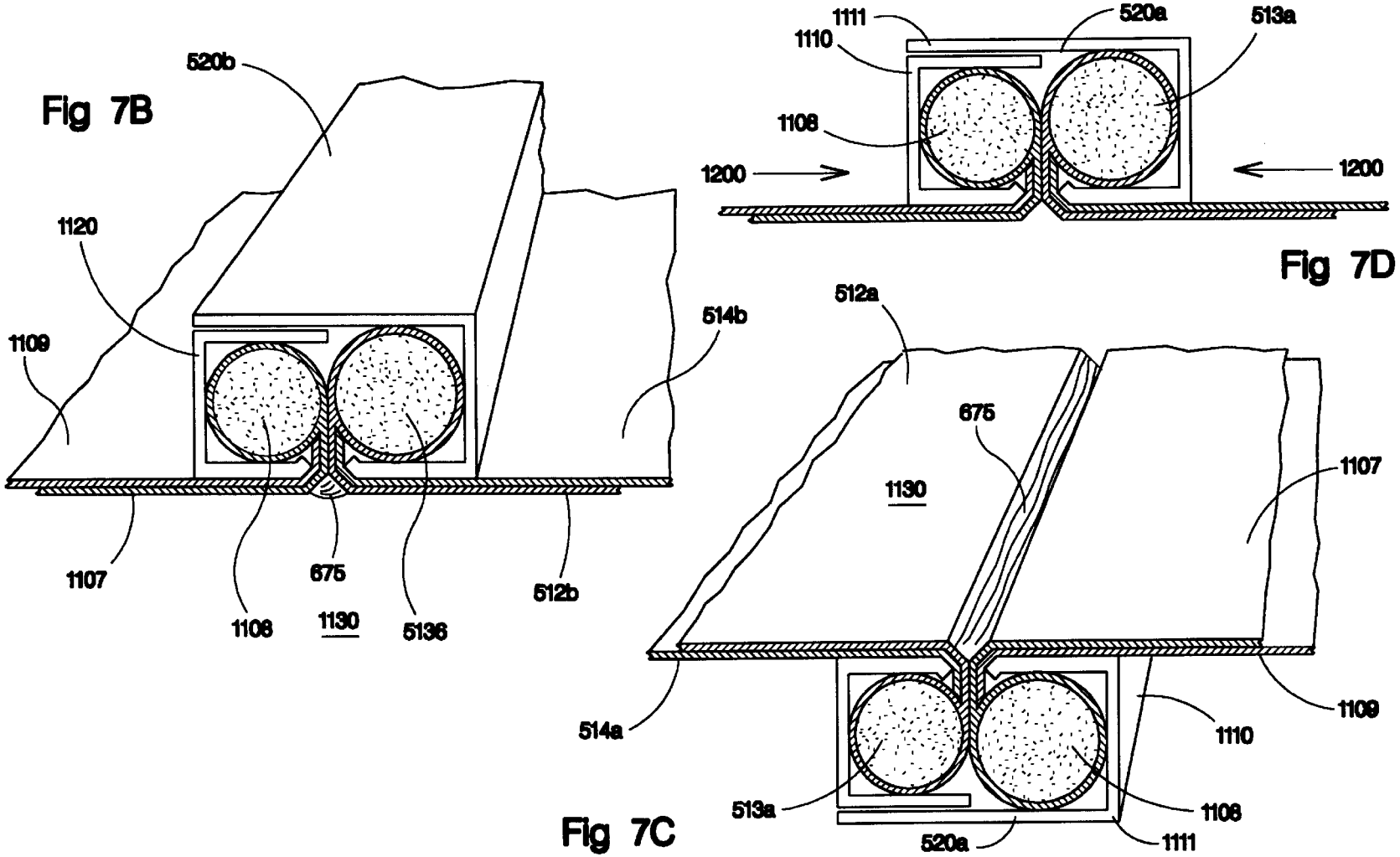
FIGS. 7B through 7G illustrate the joinder and attachment of the sealing members between the detachable passageway and wind covers and also illustrates the creation of an air tight seal using compression means.

FIGS. 7B and 7C illustrate a sectional view of the joinder of the sealing channels 1110 and 520*a* and sealing channels 1120 and 520*b*. The channels 1110 and 1120 of the detachable passageway 1100 are preferably in the form of "C" shaped channels with the inner and outer surface materials 1107 and 1109 of the passageway 1100 joined around a pliable, compressive member or ring 1108 located or positioned within such channels 1110 and 1120. The channels 520*a* and 520*b* of the wind covers 510*a* and 510*b* are preferably in the form of "J" shaped channels with the inner surface materials 512*a,b* and outer surface materials 514*a,b* joined around a pliable, compressive member or ring member 513*a,b* located or positioned within such channel sections 520*a* and 520*b*. The "J" shaped channels are comprised of two shorter arm sections and one longer arm section, while the "C" shaped channel sections are generally comprised of three shorter arm sections. Such channels have raised edges or lips along their lower arm sections to maintain the compressive members therein, which compressive members create an air-tight seal when abutting compressive members are urged toward each other as a result of the compression of the channel sections as will be described below. The channels 1110 and 1120 and compression ring members 1108 of the detachable passageway 1100 are preferably smaller than the channels 520*a,b* and compression ring members 513*a,b* of the wind covers 510*a,b* to allow for the interfitting or interconnection of the "J" shaped channels of the wind covers with the "C" shaped channels of the detachable passageway as shown. With particular reference to FIG. 7A, and due to the angled orientation or connection of the wind cover membranes with the detachable passageway, it is preferred that the "J" shaped channels be associated with the wind cover membranes 510*a,b* and the "C" shaped channels be associated with the detachable passageway 1100 so that rain and the like would flow over the "J" shaped channels and would be prevented or deterred from entering the channel sections. Rain and other elements would have an easier time penetrating the interior of the channel sections if the "C" shaped channels were associated with the wind cover membranes since the mating of the "J" and "C" shaped channels would be facing upward, or toward the sky, and not downward as in the preferred arrangement.

Figure 7F:
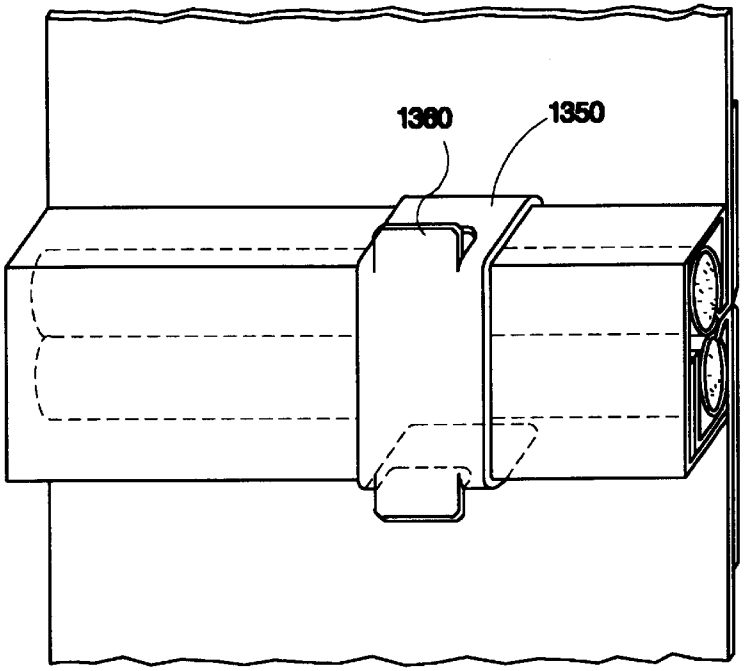
Figure 7E:
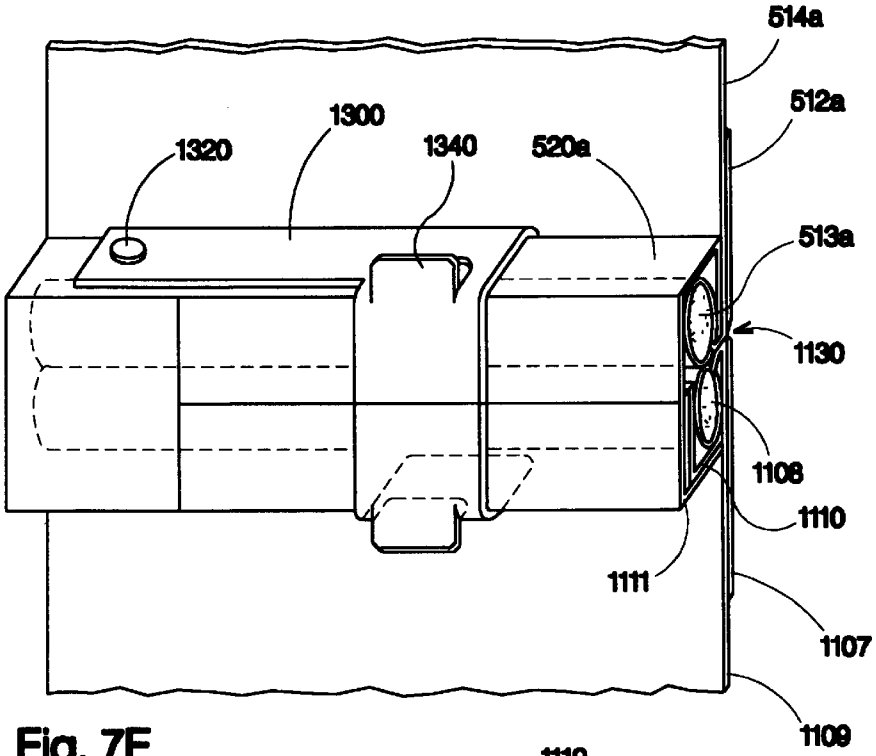

FIG. 7D illustrates the initial connection or coupling of the "J" shaped channel 520*a* with the "C" shaped channel 1110 prior to the compression of such channels, the results of which are shown in FIGS. 7B, 7C, 7E and 7F. The end 1111 of the channel 520*a* is not initially in alignment with the corner of the channel 1110 in FIG. 7D, because the channels have yet to be compressed or urged together. Once the channels are compressed in accordance with force arrows 1200, which results in the compression of the ring members 513*a* and 1108, the end 1111 of the channel 520*a* will be in alignment with the channel 1110 as shown in FIGS. 7B, 7C, 7E and 7F. The abutting compression of the ring members 513*a,b* and 1108 create an air-tight seal along the junction of the channels 520*a* and 1110, and channels 520*b* and 1120, thus creating an air-tight passageway 1100 extending between enclosures 100*a* and 100*b*. As shown in FIG. 7E, which is diagrammatic of the joinder of the channels 1110 and 520*a*, a clamp 1300 could be pivotally fastened or attached to the "J" shaped sealing tube channel 520*a* to maintain such channel 520*a* in a compressed state against the "C" shaped channel 1110. The clamp 1300 would preferably have a pivot connection 1320 and a handle section 1340 so that an operator can quickly and efficiently attach or detach the clamps 1300 prepositioned in specific distance intervals along the perimeter of the channel 520*a*. However, as illustrated in FIG. 7F, clamps 1350 only having handle sections 1360 that are more temporary in nature and not necessary pivotally attached as shown in FIG. 7E, could also be implemented around the perimeter of the joined or compressed sealing tube channels. To enhance the air tight seal created by the compressive joinder of the channel sections and the compressive abutment of the ring sections, a gel substance 675, see FIGS. 7B and 7C, could be applied along the perimeter of the junction of the channel sections from the inside of the enclosure or passageway, and preferably once a clamping arrangement is applied to the outside of the joined channel sections, to account for minute leaks that might be present along the joined channel sections. For example, wrinkles or the like along the joined membranes caused by harsh environmental conditions that could possibly alter the physical characteristics or properties of the membranes within the joined channel sections, could result in minute air leaks or the like in certain locations along the perimeter of the joined channel sections. While minute air leaks is unlikely to occur, a gel 675 applied along the junction of the membranes would fill any openings or gaps present between the abutting compressive ring members and the outside environment.

Figure 7G:
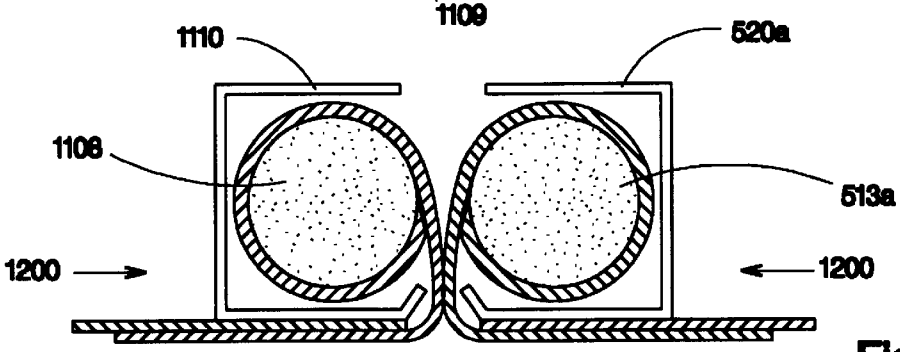

While FIGS. 7A through 7F illustrate the use of a detachable passageway for passage or communication between enclosures, it will be understood that other, alternative and equivalent structures will also be operable. For example, while the previous discussion illustrates use of a smaller, "C" shaped channel associated with detachable passageway and a larger, "J" shaped channel associated with the wind cover extensions on each enclosure, it will be understood that the wind cover extensions could utilize the smaller channel sections while the detachable passageway could utilize the larger channel sections. Alternatively, all channel sections could be "C" shaped as shown in FIG. 7G, which is an alternative to FIG. 7D but with channel sections 1110 and 513 both being "C" shaped, whereby the upper areas of the "C" shaped channel sections would be slightly shorter than the lower areas to allow for compressive joinder of the channel sections and a resultant compressive abutment of the ring sections 1108 and 513*a* positioned within such channel sections. Further, if desired, a modular connection between enclosures could be made without the use of a detachable passageway if, for example, the wind cover extensions of two enclosures were designed to mate and create an air tight seal directly. For example, one wind cover extension from one enclosure could be equipped with a larger "J" shaped channel section, while a second wind cover extension from a second enclosure could be equipped with a smaller "C" shaped channel section, for direct compressive mating between the two channel sections as discussed above. Of course, other shaped channel sections, i.e. other than "J" and "C" shaped, such as both "C" shaped channels or some other channel configurations, could be used as long as an air tight seal is created between the enclosures.

Figure 8:
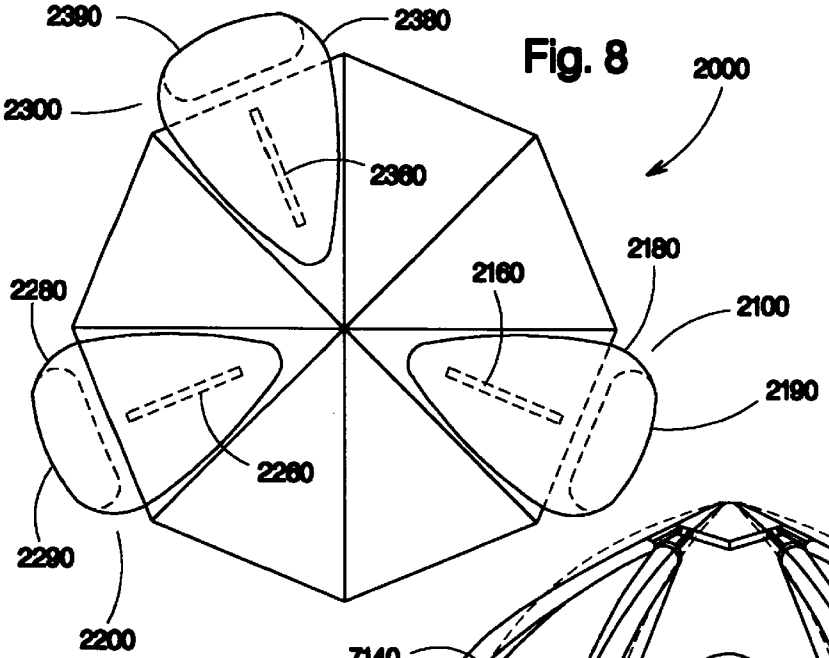
FIG. 8 is a top view of an enclosure of the invention having multiple doorways or means of ingress and egress.

The rapidly deployable enclosure of the present invention has heretofore been illustrated with a single doorway, which might be satisfactory if the enclosure was being used as a standalone unit. However, the more preferred arrangement is to have an enclosure with multiple doorways as shown in FIG. 8, which is a top view of an enclosure 2000 of the invention having three doorways, namely a main doorway 2100 and two subsidiary doorways, 2200 and 2300, all arranged in a "Y" configuration, each with its own sealing means 2160, 2260, 2360, wind cover means 2180, 2280, 2380 and sealing tube means 2190, 2290 and 2390.

Figure 9:
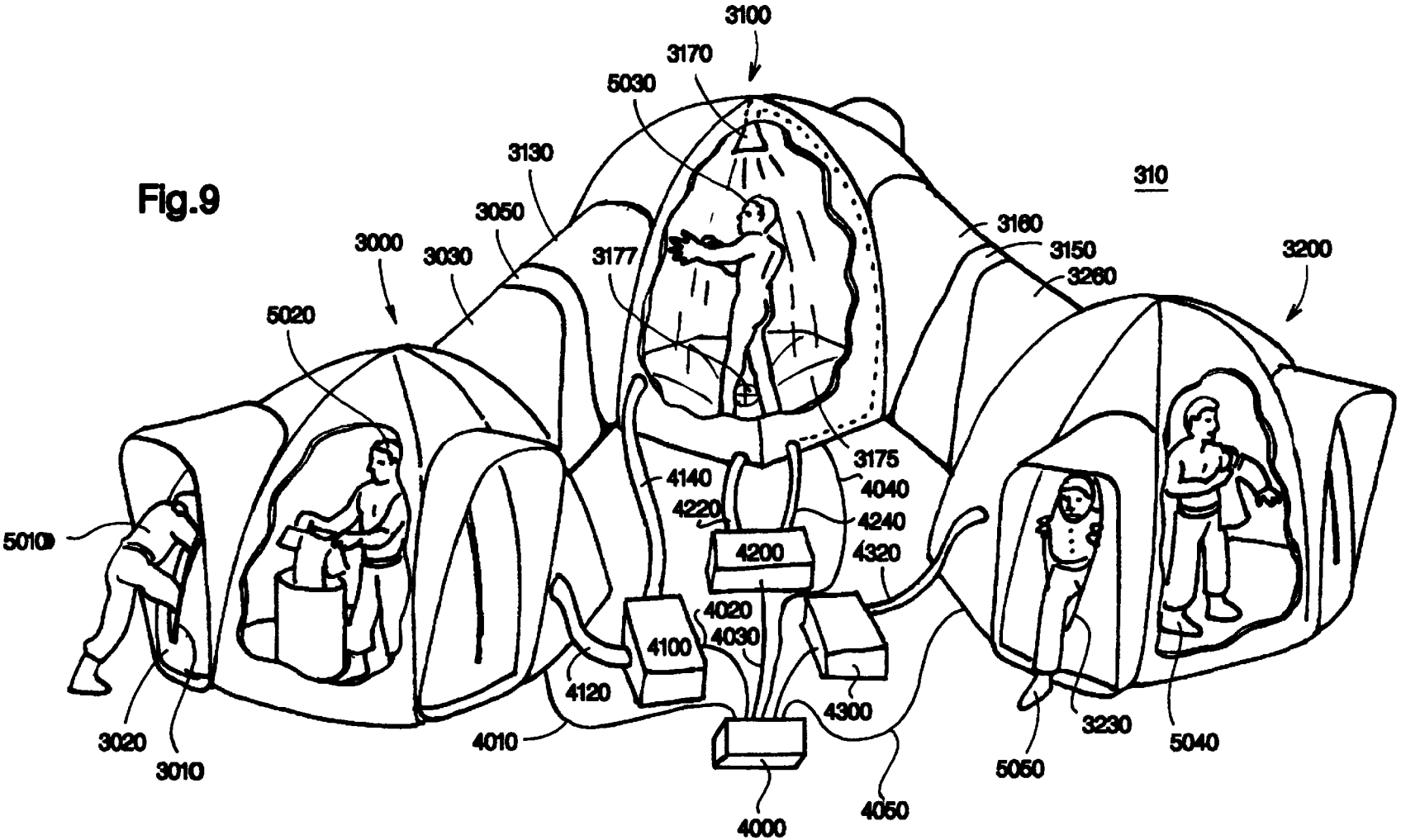
FIG. 9 is a diagrammatic view of a plurality of enclosures modularly connected.

Having an enclosure with multiple doorways enables use of such enclosure as a stand-alone unit, or in combination with other enclosures in a modular, interconnected environment as shown in FIG. 9. FIG. 9 is diagrammatically representative of an example of a village or complex of interconnected, rapidly deployable enclosures 3000, 3100 and 3200, having environmental control units 4100, 4200 and 4300, which enclosures and units are powered by a central generator 4000 by way of power lines 4010–4050. In FIG. 9, the outside environment 130 is not contaminated, but the bodies and clothing of such individuals entering the enclosure 3000 are contaminated with an unfriendly substance that is biological, chemical or the like, and such individuals must proceed through the village to become decontaminated. While such a scenario is typical for certain contamination scenes, it will be understood that the following discussion is not meant to be limiting in the manner or method of using modularly interconnected rapidly deployable enclosures of the present invention.

FIG. 9 illustrates a contaminated individual 5010 entering the enclosure 3000 through a seal 3010 in the doorway 3020, while another contaminated individual 5020 is removing his/her clothing in preparation for passage to the second enclosure 3100, where there is seen another individual 5030 showering. A detachable passageway 3050 is sealed between two doorway wind covers 3030 and 3130 as described in connection with FIGS. 7 through 7G, while a second detachable passageway 3150 is sealed air tight between two doorway wind covers 3160 and 3260 of enclosures 3100 and 3200, creating a series of passageways between enclosures. A negative pressure unit 4100 is coupled via coupling means 4120 and 4140 to the first two enclosures 3000 and 3100, to draw from such enclosures the contaminated air, which air is then filtered and returned clean to the outside environment 130. The negative pressure unit 4100 is connected to the first two enclosures 3000 and 3100 because airborne or particulate contaminated material might exist on the individuals' bodies while in both enclosures, i.e. while undressing and while showering. The middle enclosure 3100 is equipped with a water filtration system 4200, a shower unit 3170 and a contoured flooring 3175 that allows for proper drainage of water through a drain 3177, with fresh water being introduced to the shower unit 3170 through conduit 4240 and decontaminated water being returned through the drain 3177 to such water filtration system 4200 through conduit 4220. The final, "clean" enclosure 3200, obtained by passage through the wind cover 3160, passageway 3150 and wind cover 3260, is connected to a positive pressure unit 4300, which pushes clean, uncontaminated air from the outside environment 130 into the enclosure 3200. There is seen an individual 5040 dressing with uncontaminated clothing and an individual 5050 leaving through an air tight seal 3230 and wearing uncontaminated clothing. The combined operation of the positive pressure unit 4300 acting on the third enclosure 3200 and the negative pressure unit 4200 acting on the first two enclosures 3000 and 3100 ensures that contaminated air and particulate matter present within the first two enclosures 3000 and 3100 is not transmitted to the "clean" enclosure 3200.

While FIG. 9 illustrates the modularity of the rapidly erectable enclosure of the present invention with the interconnection of three enclosures, it will be understood that an unlimited number of enclosures may be modularly connected or interconnected to form a village or city of air-tight units connected by air-tight passageways. Even under the most environmentally hazardous conditions, occupants of the enclosures of the invention equipped with environmental control units and power generation systems can be assured of a livable, safe and protected environment.

Figures 10, 10A, 10B, 10C, 10D, 10E, 10F, 10G:
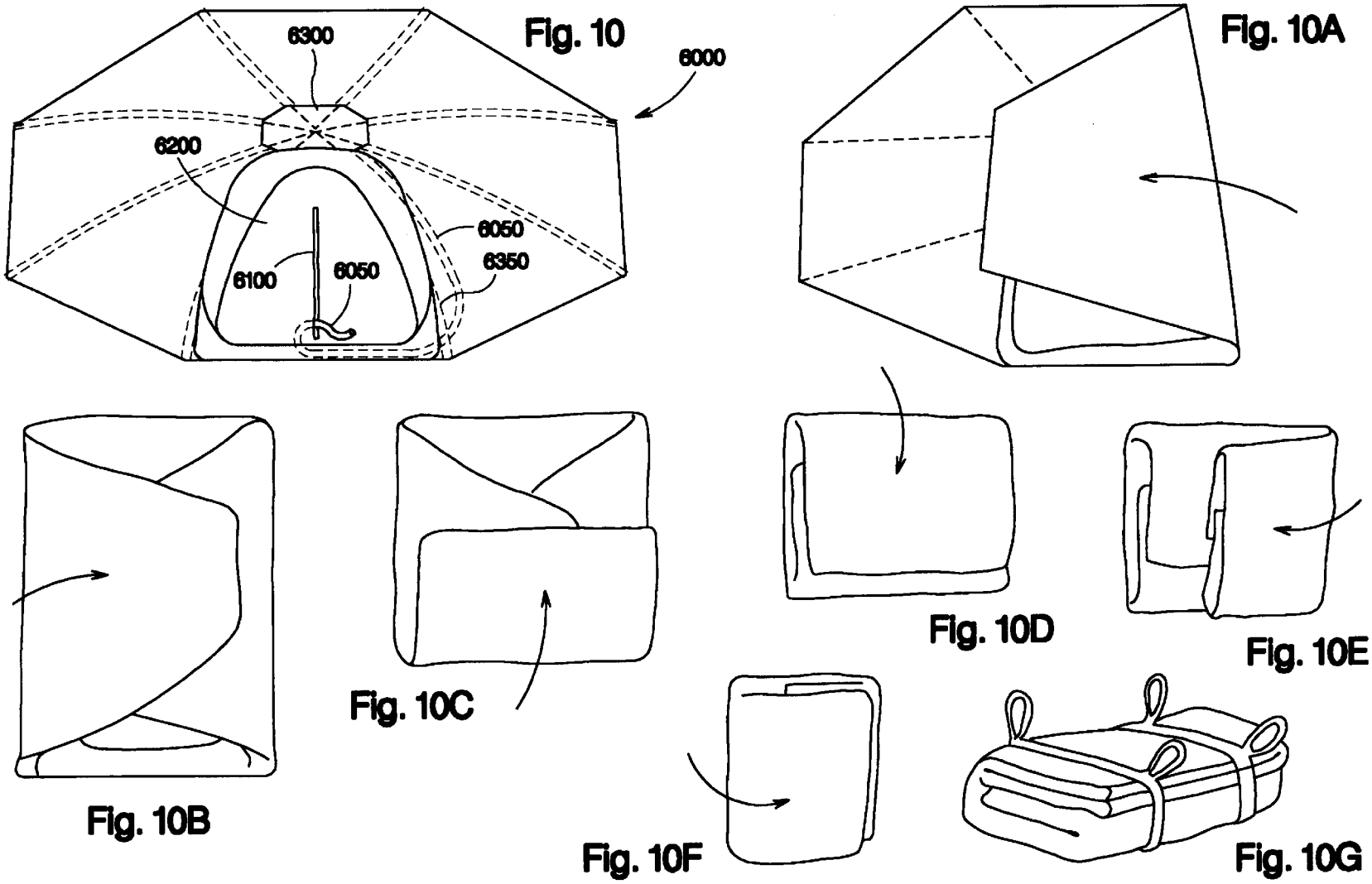
FIGS. 10 through 10G illustrate one method of a stepwise folding of a collapsed enclosure in preparation for storage.

FIGS. 10 through 10G illustrate one possible method of a stepwise folding of a collapsed enclosure 6000 of the invention, i.e. where the network or framework of all of the inflatable support members 6350 have been deflated. While the more preferred embodiment of an enclosure has multiple doorways as explained in connection with FIGS. 8 and 9, a single doorway enclosure will be illustrated for purposes of demonstration in FIGS. 10 through 10G. As shown in FIG. 10, before proceeding to fold the enclosure 6000, it is preferable to extend an air coupling tube or the like 6050, which is coupled to the manifold 6300 and supported along one of the inflatable support members (now deflated) 6350, through the air sealing means 6100 of the doorway 6200 for easy access by a fluid source (see FIG. 1) connection during erection of the enclosure when it is desired to re-erect such enclosure. It is also preferable that the sealing means 6100 be opened, such that air present within the enclosure 6000 may be evacuated during the stepwise folding and incremental reduction of an internal environment within the collapsed enclosure. FIGS. 10A through 10F illustrate the stepwise folding of the enclosure until finally the folded enclosure is in a position to be carried or otherwise transported, usually with the aid of straps 6400 or the like, as shown in FIG. 10G.

Figure 11:
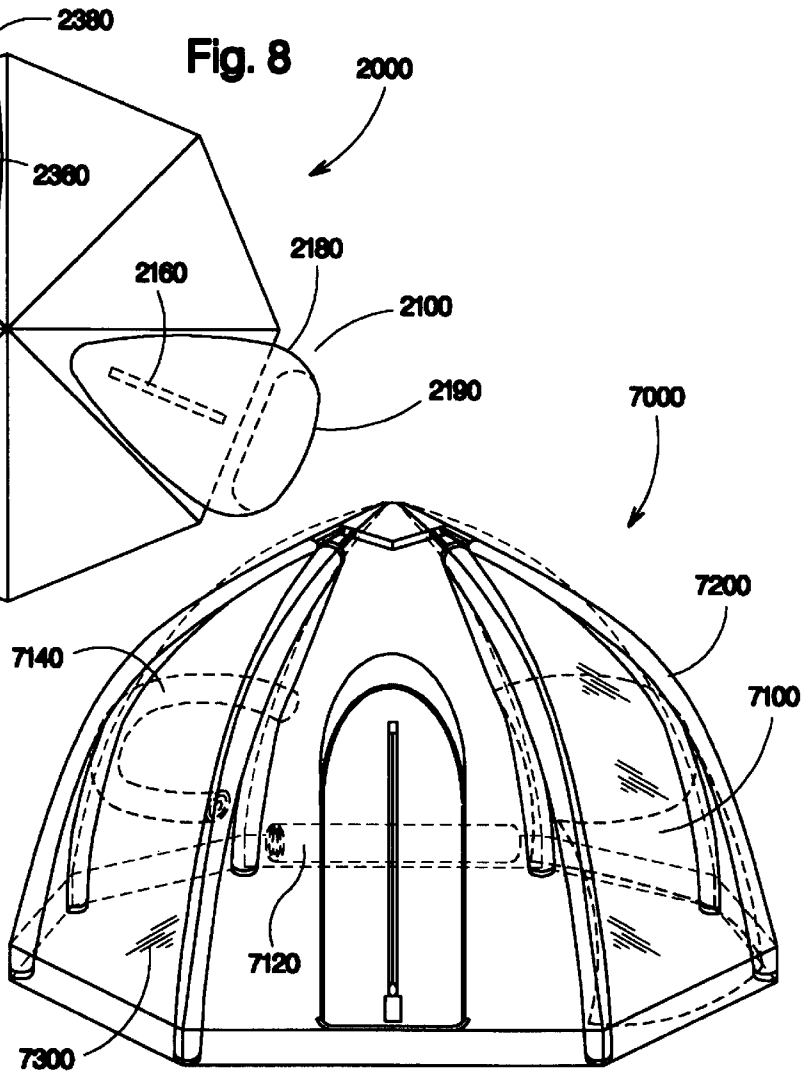
FIG. 11 is a diagrammatic view of an enclosure comprising bullet resistant shields in the extended and folded positions.

FIG. 11 illustrates an enclosure 7000 of the invention equipped with a bullet resistant feature in the form of a blanket, shield or the like 7100 having bullet resistant plates embedded therein. Preferably such bullet or shrapnel resistant plates will be at least partially overlapping. Such plates might be made from Kevlar® for example. The bullet resistant shield 7100 could be unrolled and extended between some of the inflatable support members 7200, or it could be stored and supported about the flooring 7300 in a rolled arrangement 7120, or above the flooring in a rolled arrangement 7140. Such shields are useful to include within the structures of the invention to provide some security to the occupants, both physical and psychological, from unexpected hostile fire from outside such structures.

Figure 12:
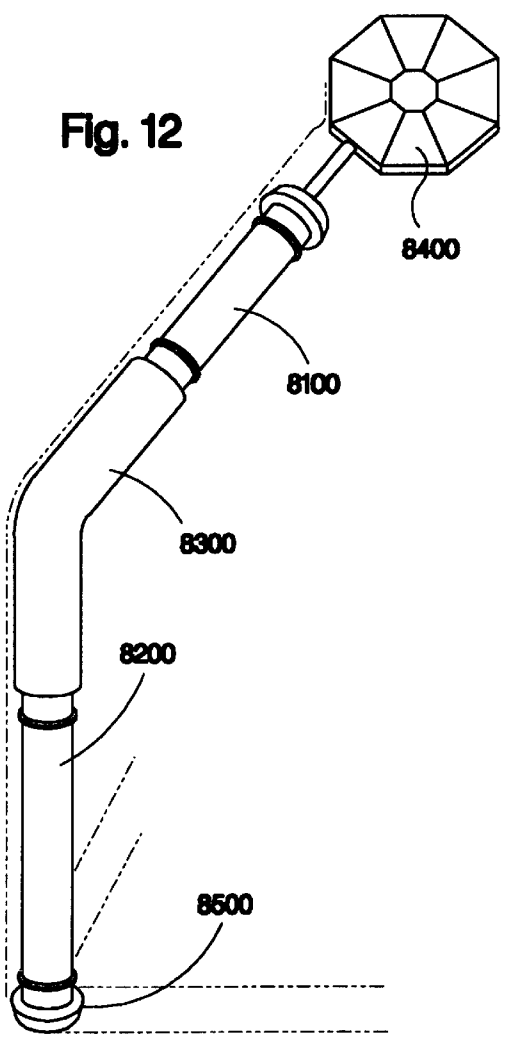
FIG. 12 is a diagrammatic view of an alternative embodiment of an inflatable support member having a collar or elbow positioned between two inflatable support member units for the reduction of bending stress on the support member units.

While the preferred embodiment of the rapidly deployable enclosure of the present invention is in the form of a dome-shaped unit as previously described and illustrated, alternatively shaped units, i.e. having a shape other than a dome, are contemplated. FIG. 12 illustrates one possible alternative embodiment having a slightly different inflatable support structure. In FIG. 12, the inflatable support structure comprises a pair of inflatable support member units 8100 and 8200 separated by an elbow 8300, which support members 8100 and 8200 are removably attachable to the elbow 8300, manifold 8400 and floor cap 8500 using attachment means as described previously. If desired, the inflatable support structure may be removably attached or pocketed against the interior surface of the protective covering as described and illustrated previously in connection with FIG. 2C. Using elbow-joined inflatable support members might be preferable in certain situations where the compression characteristics along the inner bend of the inflatable support members create a kink along the midsection which might compromise the stability of the inflatable network or framework of support members. Using elbow-joined inflatable support members will also produce a rapidly deployable enclosure having a different outside appearance, which might also be preferable in certain environmental conditions or situations. Square frames, pyramidal frames and the like are also contemplated, each having a particular network configuration of inflatable support members.

With reference to the above, deployment of the protective enclosure is fairly straightforward. With an enclosure spread out in a collapsed condition, see FIG. 10, a fluid source is coupled to the manifold through a fluid coupling extending through one of the doorways. The fluid source, usually pressurized under high pressure conditions, is then activated and fluid communication occurs between the fluid source and the manifold. Fluid is distributed through valves in the manifold to the individual inflatable support members disposed in a spaced apart relationship, which are collectively inflated to a predetermined pressure regulated at the fluid source. Once the inflatable network has reached such predetermined pressure, the fluid source is decoupled from the manifold and one-way valves maintain each inflatable support member at such predetermined pressure. The present inventor has found inflation of the support members at approximately 40 psi to be sufficient for most applications. The present inventor has also found that while the inflatable support members may vary in size and diameter depending on the size of the protective enclosure, selecting a combination of dimensions so that erection occurs in an expedited manner, and usually in less than one minute, and so that deflation of the entire enclosure also occurs in a semi-expedited manner, and usually in approximately two to five minutes, will also be found satisfactory for most applications. Of course, the dimensions could be varied so that erection and collapse occur much quicker or much slower, depending on the desires of the operator. In fact, after thoroughly reviewing the operation manual provided with the protective enclosure, a single person having no construction skills or prior knowledge of the invention can erect the enclosure within a very abbreviated amount of time, including making any necessary adjustments for proper operation. Disassembly and re-packing of the protective enclosure normally requires a few minutes more.

Once erect, an occupant of the enclosure can create an air-tight seal between the interior and outside environment through use of the unique gel system disposed at the terminus of the slidable sealing member. A positive pressure within the enclosure urges the gel system against any air leak present at the terminus of the slidable sealing member, and such positive pressure also ensures the flow of air from the interior through minor holes or tears in the flexible protective membrane. Adjustable venting means are also provided to regulate the positive pressure within the enclosure and respond to potential integrity breaches in the protective membrane or covering.

If the integrity of the protective membrane and an inflatable support is breached, via the passage of a forceful object, such as shrapnel or the like, through such membrane and through such inflatable support covering, the inflatable support member can be decoupled from the manifold and easily disassembled without effecting the inflation or operation of any of the unbreached inflatable support members. Prior to reassembly and reattachment of a repaired or replacement inflatable support member, the protective membrane is patched or otherwise repaired from within the enclosure. Once the integrity of the protective membrane or enclosure has been assured, the repaired or replacement inflatable support member is reattached to the manifold system, and a fluid source is recoupled to the manifold for pressurization of the repaired or replacement support member. It is highly preferred, if not critical, that a fluid source be present within the enclosure, so that the system, and more importantly the replacement support member, can be repaired and repressurized from within the enclosure. Most, if not all, of the structural elements of the protective enclosure are repairable and/or replaceable from within the enclosure by accessing replacement parts and repair means stored or brought into the enclosure. The ability to repair, replace parts and restore the flexible membrane and structural inflatable framework from within the protective enclosure can be critical, especially if the protective enclosure is located in a highly contaminated environment. In light of this, the protective enclosure of the invention will be equipped with all tools necessary to unpack, erect, collapse and re-pack the structure. No additional equipment, e.g., hand tools, power tools, scaffolding, ladders, cranes, forklifts or other heavy lifting machinery, is needed. The entire structure's components and accessories can be connected using ordinary, everyday tools, that are provided as part of an erection kit. No welding, bonding or any other skilled operations are required for erection of the rapidly deployable protective enclosure. Breakdown or collapse of an erected enclosure occurs rather expeditiously by bleeding the fluid from the inflated support members through bleed valves on the manifold.

A variety of embodiments have been illustrated having varying levels of structural protection. For example, a very basic protective unit could be provided which is merely constructed from an uninsulated waterproof membrane, has waterproof flooring and uses zippered doorways that are not air tight. A more standard unit, particularly for military applications, might instead be constructed from an air tight and water tight, insulated protective membrane having a reversible outer cover and other desirable qualities for military use, and be equipped with a venting system for regulating air flow within the enclosure and through to the environment. For highly intense operations, a village or complex of air-tight, modularly connected protective enclosures having bullet-resistant shields, environmental control units and decontamination systems associated with each or only select enclosures could be created having superior protection and resistance to a highly intense, extremely adverse or hostile outer environment. Furthermore, under highly extreme conditions, such as combat, heavy wind or the like, the protective enclosure might come with a quick-erect, failsafe back-up structural support system comprised of, for example, fiberglass tensioning rods for enforcing the network of inflatable support members.

The protective enclosure of the present invention is the answer to a long sought-after problem, particularly for the military. Having a self-deploying, lightweight, extremely portable, rapid erect, airtight & watertight structure to house personnel for a variety of purposes can be critical in the harshest of forward operational areas. Having a structure that is also strengthened by a network of inflatable support members, each providing individual framing capability, and each individually and easily repairable or replaceable from within the enclosure, ensures that the structure, and therefore the occupants, will have a better chance of surviving if an integrity breach occurs in a highly adverse, contaminated environment.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

I claim:

1. A rapidly deployable structure for use in adverse or hostile conditions comprising:

a. a plurality of inflatable support members dimensioned to receive an inflating fluid and disposed in a spaced apart relationship within a protective covering, such inflatable support members defining a frame for support of the protective covering upon introduction and retention of a fluid therein, b. a fluid distribution member mounted in conjunction with the protective covering and adapted for fluid communication between the plurality of inflatable support members and an inflating fluid source, such that fluid communication may occur individually or collectively between the fluid source and each inflatable support member, c. the protective covering having an inside surface adjacent which the plurality of inflatable support members are disposed, and an outside surface subject to external environmental conditions, d. each inflatable support member having a first end coupleable to the fluid distribution member and a second end opposite the first end and adapted to maintain a fluid within such support member, e. each inflatable support member being separately coupleable and decoupleable with respect to the fluid distribution member and removable from within the structure, such that the removal and replacement of an inflatable support member with respect to the fluid distribution member does not change the amount of fluid present in any inflatable support member that remains coupled to the fluid distribution member.

2. A rapidly deployable structure in accordance with claim 1 wherein the fluid distribution member comprises a plurality of independently controllable valves that enable independent control of the passage of fluid between each inflatable support member and the fluid distribution member.

3. A rapidly deployable structure in accordance with claim 2 wherein each of the valves is switchable between a first position allowing ingress of the inflating fluid to the associated inflatable support member but preventing egress of the inflating fluid therefrom, and a second position allowing egress of the inflating fluid therefrom.

4. A rapidly deployable structure in accordance with claim 1 wherein the inflatable support members are releasably retained against the inside surface of the protective covering.

5. A rapidly deployable structure in accordance with claim 4 further comprising a sleeve associated with each inflatable support member that releasably retains each inflatable support member against the inside surface of the protective covering.

6. A rapidly deployable structure in accordance with claim 1 further comprising at least one doorway having a seal for passage between the interior of the enclosure and the surrounding environment.

7. A rapidly deployable structure in accordance with claim 6 wherein the seal is capable of achieving an air tight closure between the interior of the enclosure and the surrounding environment.

8. A rapidly deployable structure in accordance with claim 7 wherein the seal capable of achieving an air tight closure further comprises a slidable sealing member having a handle member and a tip portion, an interlocking track having an initial end and a terminal end upon which the slidable sealing member slides, and a chamber of fluid located at the terminal end of the interlocking track into which the slidable sealing member slides for blocking an opening present just beyond the tip portion of the slidable sealing member.

9. A rapidly deployable structure in accordance with claim 7 further comprising an environmental control unit that is capable of regulating or maintaining the interior atmosphere of rapidly deployable structure for the benefit of its occupants and their accessories.

10. A rapidly deployable structure in accordance with claim 9 further comprising a power supply.

11. A rapidly deployable structure in accordance with claim 1 wherein the rapidly deployable structure is capable of being modularly coupled with other rapidly deployable structures to form groups of interconnected rapidly deployable structures.

12. A rapidly deployable structure in accordance with claim 11 wherein groups of interconnected rapidly deployable structures are coupled by detachable passageways.

13. A rapidly deployable structure in accordance with claim 12 wherein the interconnection between the rapidly deployable structures and the detachable passageways is air tight.

14. A rapidly deployable structure in accordance with claim 1 further comprising a layer of insulation between the inside and outside surfaces of the protective covering.

15. A conveniently and rapidly deployable protective shelter comprising:

(a) An outer membrane adapted to be supported in the configuration of an enclosure by a structural framework, (b) the structural framework being comprised of:

(i) a plurality of flexible inflatable tubes, (ii) a manifold for detachable communication to one end of the plurality of said flexible inflatable tubes, (iii) said manifold incorporating valve means for independent control of access of an inflation medium to individual tubes of said plurality of flexible inflatable tubes, (c) means to prevent egress of fluid from a second end of said plurality of flexible inflatable tubes, (d) said tubes being arranged within the membrane when connected to the manifold such that when inflation medium is admitted to said tubes from said manifold, such tubes as they inflate lift and support the at least semi-flexible membrane to form an enclosure, and (e) said individual tubes being individually deflatable and removable from the manifold and enclosure and replaceable with substitute tubes without disturbance of the remainder of the tubes.

16. A conveniently and rapidly deployable shelter in accordance with claim 15 including valve means associated with each tube wherein upon rupture and the like of one or more of the flexible inflatable tubes with resultant loss of internal pressure in such tube or tubes, the valve means for such tube will close off access from the manifold to such tube.

17. A rapidly deployable enclosure for the protection of occupants situated in the interior of the enclosure from an outside environment comprising:

a. a flexible membrane defining a barrier between the interior of the enclosure and the outside environment, b. a framework defined by a plurality of individual inflatable and deflatable support members disposed in a spaced apart relationship within the flexible membrane and adapted to be freestanding within the enclosure upon the inflation of such inflatable support members with a fluid, and c. the framework being capable of maintaining a free-standing posture when one of the inflatable support members is removed for repair and replacement from within the interior of the enclosure.

18. A rapidly deployable enclosure in accordance with claim 17 wherein the inflatable support members are adapted for inflation pressures exceeding 100 pounds per square inch.

19. A rapidly deployable enclosure in accordance with claim 18 further comprising means for maintaining an air tight environment within the enclosure.

20. A rapidly deployable and repairable protective shelter comprising:

(a) an outer membrane providing at least a partial separation between an outer environment on one side of the membrane and a sheltered region on the opposite side of such membrane, (b) a structural support for said membrane comprised of a plurality of individual inflatable and deflatable members arranged in a supporting framework for said membrane, (c) the inflatable and deflatable members being individually removable from the structural support and replaceable by similar inflatable and deflatable members without collapse of the shelter as a whole.

21. A rapidly deployable and repairable protective shelter in accordance with claim 20 wherein the separately inflatable members are individually attached through valve means to an inflation fluid distribution means.

22. A rapidly deployable and repairable protective shelter in accordance with claim 21 wherein the valve means includes independently controllable valves that enable independent control of the passage of inflation fluid between each inflatable support member and the fluid distribution means.

23. A rapidly deployable and repairable protective shelter in accordance with claim 22 wherein each of the valves is switchable between a first position allowing ingress of the inflation fluid to the associated inflatable support member, but preventing egress of the inflation fluid therefrom, and a second position allowing egress of the inflation fluid therefrom.

24. A rapidly deployable and repairable protective shelter in accordance with claim 20 wherein the inflatable support members are releasably retained against the inside surface of the membrane.

25. A rapidly deployable structure in accordance with claims 24 further comprising a sleeve means associated with each inflatable support member that releasably retains each inflatable support member against the inside surface of the membrane.

26. A rapidly deployable and repairable protective shelter in accordance with claim 21 further wherein the membrane forms a substantially completely enclosed chamber.

27. A rapidly deployable and repairable protective shelter in accordance with claim 26 comprising at least one doorway having a seal for passage between the interior of the enclosure and the surrounding environment.

28. A rapidly deployable structure in accordance with claim 27 wherein the seal is capable of achieving an air tight closure between the interior of the enclosure and the surrounding environment.

29. A rapidly deployable and repairable protective shelter in accordance with claim 28 wherein the seal capable of achieving an air tight closure further comprises a slidable sealing member having a handle member and a tip portion, an interlocking rack having an initial end and a terminal end upon which the slidable sealing member slides, and a chamber of fluid located at the terminal end of the interlocking track into which the slidable sealing member slides for blocking an opening present just beyond the tip portion of the slidable sealing member.

30. A rapidly deployable and repairable protective shelter in accordance with claim 21 including valve means associated with each inflatable support member wherein upon rupture and the like of one or more of the inflatable support members with resultant loss of internal pressure in such members, the valve means for such members will close off access from the inflation fluid distribution means to such inflatable support members.

* * * * *